US009207593B2

(12) United States Patent
Fukamachi

(10) Patent No.: US 9,207,593 B2
(45) Date of Patent: Dec. 8, 2015

(54) IMAGE HEATING APPARATUS AND IMAGE FORMING APPARATUS

(71) Applicant: CANON KABUSHIKI KAISHA, Tokyo (JP)

(72) Inventor: Asuna Fukamachi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/244,195

(22) Filed: Apr. 3, 2014

(65) Prior Publication Data

US 2014/0308050 A1 Oct. 16, 2014

(30) Foreign Application Priority Data

Apr. 10, 2013 (JP) ..... 2013-081873

(51) Int. Cl.
*G03G 15/20* (2006.01)

(52) U.S. Cl.
CPC ..... *G03G 15/2039* (2013.01); *G03G 15/2017* (2013.01); *G03G 15/2053* (2013.01)

(58) Field of Classification Search
CPC ..... G03G 15/2017; G03G 21/206; G03G 15/2028
See application file for complete search history.

(56) References Cited

U.S. PATENT DOCUMENTS

2010/0284706 A1* 11/2010 Ito et al. ..... 399/69

FOREIGN PATENT DOCUMENTS

| | | | |
|---|---|---|---|
| JP | 09-114286 | A | 5/1997 |
| JP | 2004-037555 | A | 2/2004 |
| JP | 2006-078555 | A | 3/2006 |

* cited by examiner

*Primary Examiner* — Roy Y Yi
(74) *Attorney, Agent, or Firm* — Fitzpatrick, Cella, Harper & Scinto

(57) ABSTRACT

An image heating apparatus includes an image heating member configured to heat an image on a recording medium, a heat source heating the image heating member from an inside thereof, an image heating temperature detecting member detecting the surface temperature of the image heating member, an external heating member heating the image heating member from an outside of the image heating member, a cooling fan cooling a surface of the image heating member, and a control portion. The control portion is configured to execute a first mode of controlling the temperature detected by the image heating temperature detecting member under a predetermined control condition to a target temperature while executing a preceding job and a second mode of switching the predetermined control condition while maintaining the setting of the target temperature while processing the preceding job.

10 Claims, 11 Drawing Sheets

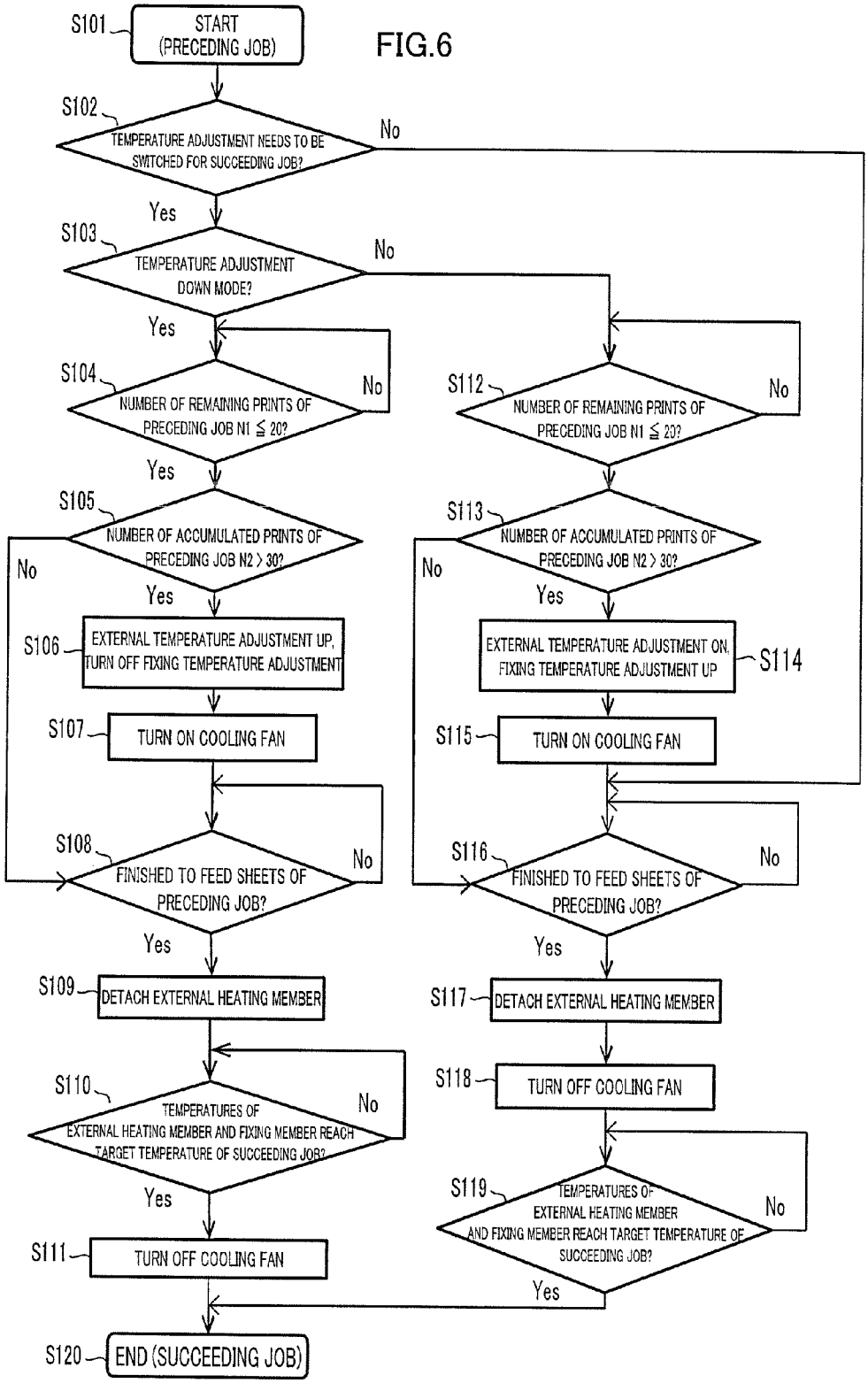
FIG.6
S101
START (PRECEDING JOB)
S102
TEMPERATURE ADJUSTMENT NEEDS TO BE SWITCHED FOR SUCCEEDING JOB?
No
Yes
S103
TEMPERATURE ADJUSTMENT DOWN MODE?
No
Yes
S104
NUMBER OF REMAINING PRINTS OF PRECEDING JOB N1 ≦ 20?
No
Yes
S105
NUMBER OF ACCUMULATED PRINTS OF PRECEDING JOB N2 > 30?
No
Yes
S106
EXTERNAL TEMPERATURE ADJUSTMENT UP, TURN OFF FIXING TEMPERATURE ADJUSTMENT
S107
TURN ON COOLING FAN
S108
FINISHED TO FEED SHEETS OF PRECEDING JOB?
No
Yes
S109
DETACH EXTERNAL HEATING MEMBER
S110
TEMPERATURES OF EXTERNAL HEATING MEMBER AND FIXING MEMBER REACH TARGET TEMPERATURE OF SUCCEEDING JOB?
No
Yes
S111
TURN OFF COOLING FAN
S112
NUMBER OF REMAINING PRINTS OF PRECEDING JOB N1 ≦ 20?
No
S113
NUMBER OF ACCUMULATED PRINTS OF PRECEDING JOB N2 > 30?
No
Yes
S114
EXTERNAL TEMPERATURE ADJUSTMENT ON, FIXING TEMPERATURE ADJUSTMENT UP
S115
TURN ON COOLING FAN
S116
FINISHED TO FEED SHEETS OF PRECEDING JOB?
No
Yes
S117
DETACH EXTERNAL HEATING MEMBER
S118
TURN OFF COOLING FAN
S119
TEMPERATURES OF EXTERNAL HEATING MEMBER AND FIXING MEMBER REACH TARGET TEMPERATURE OF SUCCEEDING JOB?
No
Yes
S120
END (SUCCEEDING JOB)

IMAGE HEATING APPARATUS AND IMAGE FORMING APPARATUS

BACKGROUND OF THE INVENTION

1. Field of the Invention

The present invention relates to an image heating apparatus configured to heat a toner image formed on a recording medium and to an image forming apparatus including such an image heating apparatus.

2. Description of the Related Art

Lately, a fixing apparatus is often used in an image forming apparatus employing an electro-photographic unit such as a copier, a printer, a multi-function printer or the like. The fixing apparatus is configured to fix a toner image by heating and pressing the toner image onto a sheet, i.e., a recording medium, when the recording medium passes through a fixing nip portion formed between an image heating member such as a fixing roller and a pressure member such as a pressure roller. The image heating member and the pressure member in the fixing apparatus is merchandized also as a combination of a roller member and a belt member or of belt members, beside the combination of the roller members.

By the way, an image forming apparatus for use in a print-on-demand market in particular is required to speed up in forming images and to be able to accommodate to various kinds of media lately. In speeding up the formation of images, it is preferable to assure a quantity of heat that enables to continuously fix toner images on recording media because a temperature of a fixing nip portion tends to drop significantly when the recording medium (thick sheet) whose basis weight is large passes through the nip portion and it may lead an occurrence of poor fixing.

Then, Japanese Patent Application Laid-open No. 2004-37555 proposes a fixing apparatus (image heating apparatus) configured such that a fixing roller is heated from outside by an external heating member such as an external heating roller brought into contact with the fixing roller as a technology of improving heating performance and to improve productivity in printing thick sheets.

Still further, in a case of dealing with the various types of media, an optimum quantity of heat is different per each medium from aspects of image nature such as a toner offset nature and glossiness of images and conveyance such as wrinkles, waviness of the recording medium, fixing separation between a thin sheet whose basis weight is small and a thick sheet or between a non-coated sheet and a coated sheet. Therefore, Japanese Patent Application Laid-open No. 2006-78555 proposes a technology of controlling a temperature adjustment temperature (target temperature) of the image heating member described above by switching to an optimum temperature corresponding to each type of the recording media to improve a quantity of heat supplied per unit time.

Japanese Patent Application Laid-open No. H9-114286 also proposes a technology of shortening a time required to change the temperature adjustment temperature (target temperature) by cooling the image heating member by blowing air from a fan to the image heating member.

However, productivity in the case where media are mixedly loaded is problematic if the method of switching the temperatures as described above is employed. That is, in a case where a so-called "media consolidated job (consolidated job)" in which different types of media, e.g., thin and thick sheets, are mixed is to be carried out, it takes a time to change the target temperatures of the image heating member, thus generating a stand-by time. The stand-by time is prolonged further in the image forming apparatus trying to improve productivity in printing the thick sheets as described above because the image heating member thereof is constructed such that its thermal capacity is large.

SUMMARY OF THE INVENTION

According one aspect of the invention, an image heating apparatus includes an image heating member configured to heat an image on a recording medium, a heat source heating the image heating member from an inside thereof, an image heating temperature detecting member detecting a surface temperature of the image heating member, an external heating member heating the image heating member from an outside of the image heating member in a state in contact with the image heating member, a cooling fan cooling a surface of the image heating member, and a control portion controlling the heat source, the external heating member, and the cooling fan. In a case of executing a preceding job by receiving a consolidated job in which a first recording medium whose basis weight is a predetermined value or more and a second recording medium whose basis weight is less than the predetermined value are sent sequentially in a relationship of the preceding job and a succeeding job, the control portion is capable of a executing first mode of controlling a temperature detected by the image heating temperature detecting member under a predetermined control condition at a target temperature in the preceding job and a second mode of switching the predetermined control condition while maintaining a setting of the target temperature in a middle of processing the preceding job.

According another aspect of the invention, an image heating apparatus includes an image heating member configured to heat an image on a recording medium, a heat source heating the image heating member from an inside of the image heating member, an image heating temperature detecting member detecting a surface temperature of the image heating member, an external heating member heating the image heating member from an outside of the image heating member while in contact with the image heating member, a cooling fan cooling a surface of the image heating member, and a control portion controlling the heat source, the external heating member, and the cooling fan. In executing the preceding job by receiving a consolidated job in which a recording medium whose basis weight is less than a predetermined value and a recording medium whose basis weight is the predetermined value or more are sent sequentially in a relationship of a preceding job and a succeeding job, the control portion is capable of executing a mode of controlling a temperature detected by the image heating temperature detecting member under a predetermined control condition at a target temperature in the preceding job and a mode of switching the predetermined control condition while maintaining a setting of the target temperature in a middle of processing of the preceding job.

According to a still other aspect of the invention, an image heating apparatus includes an image heating member configured to heat an image on a recording medium, an image heating temperature detecting member detecting a surface temperature of the image heating member in contact with the image to be heated, a first temperature adjustment portion adjusting the surface temperature of the image heating member from an inside of the image heating member, a second temperature adjustment portion adjusting the surface temperature of the image heating member from an outside of the image heating member, and a control portion controlling the first and second temperature adjustment portions. The control portion is also capable of executing a preliminary control in a case of heating at least either one recording medium among a first recording medium and a second recording medium whose basis weight is smaller than that of the first recording medium in succession after heating the plurality of other recording media. The control portion executes the preliminary control in a middle of heating of a plurality of the other recording media while maintaining a setting of a target temperature of a temperature detected by the image heating temperature detecting member at a target temperature corresponding to the other recording medium by changing a quantity of heat supplied from the first temperature adjustment portion to the image heating member based on a target temperature of the temperature detected by the image heating temperature detecting member corresponding to the one recording medium and by controlling the second temperature adjustment portion such that the temperature detected by the image heating temperature detecting member is adjusted to the target temperature corresponding to the other recording medium.

Further features of the present invention will become apparent from the following description of exemplary embodiments (with reference to the attached drawings).

BRIEF DESCRIPTION OF THE DRAWINGS

FIG. 6 is a flowchart showing operations of the first embodiment.

DESCRIPTION OF THE EMBODIMENTS

First Embodiment

Figure 1:
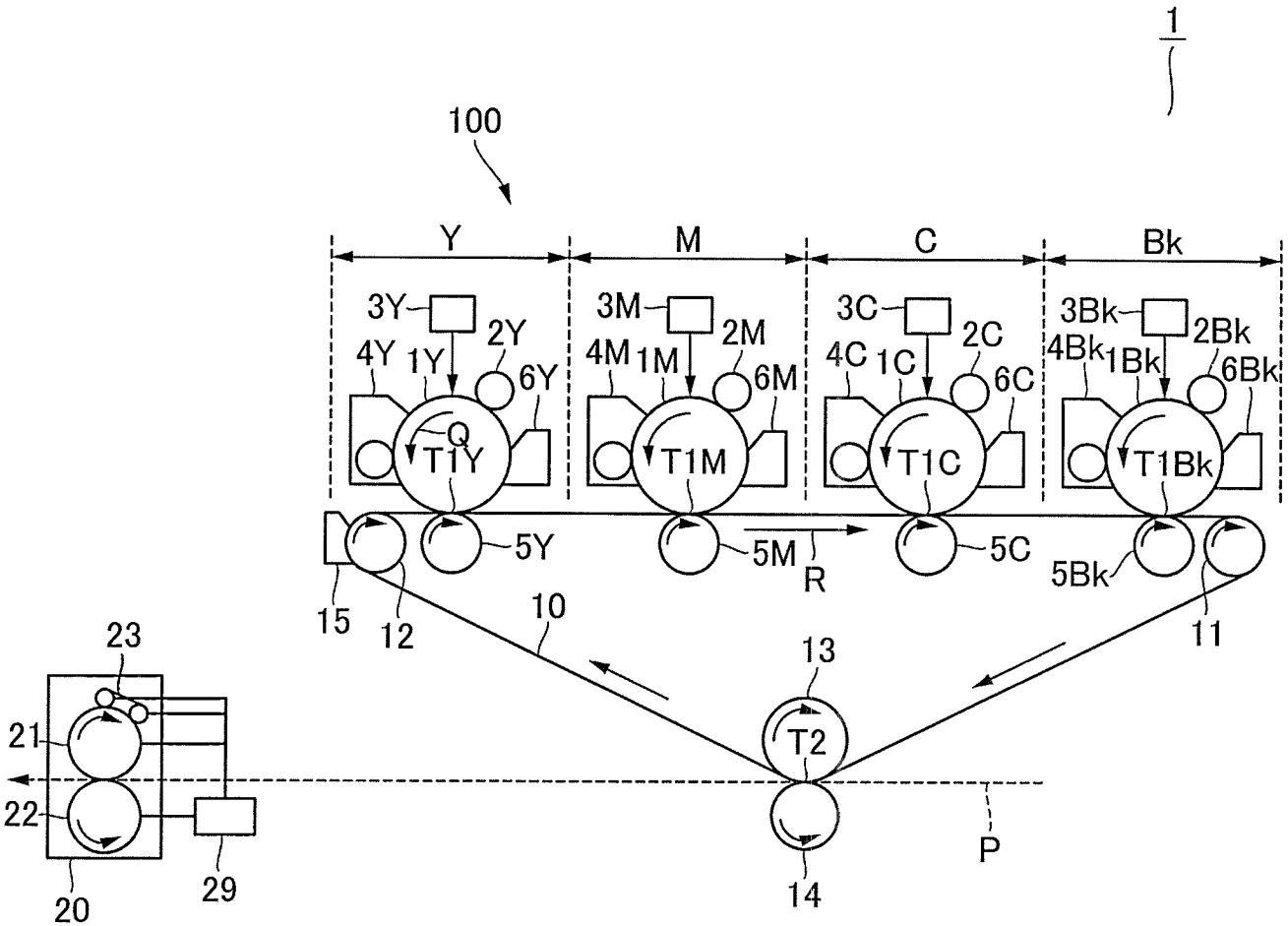
FIG. 1 is a schematic structural view schematically showing a configuration of an image forming apparatus of a first embodiment.

Embodiments of the present invention will be explained below with reference to the drawings. It is noted that while a fixing apparatus configured to fix a non-fixed image onto a recording medium will be described in the following embodiments, the present invention can be carried out also as a heat processing apparatus configured to control a surface nature of an image by heating and pressing a recording medium carrying a fixed image or a semi-fixed image.

Firstly, an image forming apparatus 1 and a fixing apparatus 20, i.e., an image heating apparatus, of a first embodiment will be described. In succession, a temperature adjustment control of a fixing roller 21, i.e., an image heating member or a fixing member, a temperature adjustment control of an external heating belt 23, i.e., an external heating member, and a control on operations of a cooling fan 38 in performing a job in which different media are mixedly loaded (referred to as a "consolidated job" hereinafter) characteristic in the present embodiment.

[Image Forming Apparatus]

The image forming apparatus 1 is a color image forming apparatus using an electro-photographic system. As shown in FIG. 1, the image forming apparatus 1 includes four image forming units Y (yellow), M (magenta), C (cyan) and Bk (black) respectively forming four different color toner images as an image forming portion 100 forming the toner image on a recording medium. An endless intermediate transfer belt 10, i.e., an intermediate transfer body, is disposed along a direction in which these image forming units Y, M, C, and Bk are arrayed.

Because the four image forming units Y, M, C, and Bk described above have similar configurations from each other, the configuration of only the yellow image forming unit Y will be typically described below. As for the image forming units M, C, and Bk, structures and operational members thereof common with those of the image forming unit Y will be denoted by the same reference numerals and subscripts indicating the respective units of the reference numerals will be changed.

A cylindrical electro-photographic photoconductor (referred to as a "photoconductive drum" hereinafter) 1Y whose surface layer is formed of OPC (organic photo conductor) for example is rotationally driven in a direction of an arrow Q in FIG. 1 as an image carrier. A charging roller 2Y charges the surface of the photoconductive drum 1Y homogeneously. That is, the charging roller 2Y to which a predetermined bias is applied comes in contact with and driven by the photoconductive drum 1Y and charges the surface of the photoconductive drum 1Y with a predetermined potential. The charged photoconductive drum 1Y is exposed by an exposure light such as laser beam emitted from an exposure unit 3Y to form an electrostatic latent image corresponding to a color separated image of an inputted original.

A developing unit 4Y develops the electrostatic latent image by using toner charged by a developing roller to form a toner image corresponding to the electrostatic latent image on the surface of the photoconductive drum 1Y. The toner image on the photoconductive drum 1Y is primarily transferred to the intermediate transfer belt 10 rotating with a substantially same speed with a peripheral speed of the photoconductive drum 1Y by a primary transfer roller 5Y at a primary transfer nip portion T1Y between the photoconductive drum 1Y and the primary transfer roller 5Y.

The toner left on the photoconductive drum 1Y after the primary transfer is recovered by a drum cleaning unit 6Y including a blade, a brush or the like. The photoconductive drum 1Y from which the residual toner has been removed is charged homogeneously again by the charging roller 2Y to repeatedly create an image.

The intermediate transfer belt 10 is stretched around a driving roller 11, a support roller 12 and a backup roller 13. The intermediate transfer belt 10 is rotationally driven in a direction of an arrow R by the driving roller 11 which rotates in a direction of an arrow in FIG. 1 while being in contact with the respective photoconductive drums 1Y, 1M, 1C, and 1Bk of the four image forming units Y, M, C, and Bk.

In a case where a full-color mode (full-color image forming mode) is selected in the image forming apparatus 1, the imaging operations described above are executed by the four image forming units Y, M, C, and Bk. Then, a yellow toner image, a magenta toner image, a cyan toner image, and a black toner image formed respectively on the photoconductive drums 1Y, 1M, 1C, and 1Bk are superimposed and transferred sequentially on the intermediate transfer belt 10. It is noted that an order of colors is not limited to what described above, and is arbitrary depending on an image forming apparatus.

The four color toner images superimposed and transferred onto the intermediate transfer belt 10 are secondarily transferred to a recording medium P altogether at a secondary transfer portion T2 where the backup roller 13 (the intermediate transfer belt 10) is in contact with a secondary transfer roller 14. The recording medium P is fed from a sheet feed cassette not shown by being separated one by one and is supplied to the secondary transfer portion T2 with a predetermined control timing adjusted to the toner image superimposed and transferred to the intermediate transfer belt 10 by a registration roller pair not shown.

Then, the recording medium P on which the toner image has been transferred is guided into a fixing apparatus 20, i.e., an image heating apparatus, to fix the full-color toner image on the recording medium P by heating and pressing the toner image on the recording medium P. That is, the fixing apparatus 20 functions such that the toner image formed on the recording medium P by the image forming portion 100 is fixed on the recording medium P. The toner left on the intermediate transfer belt 10 after the secondarily transfer is recovered by a belt cleaning unit 15 including a blade, a brush or the like. Then, the intermediate transfer belt 10 from which the toner left after the secondarily transfer has been removed undergoes the primary transfer again to repeatedly form another image.

In a case of a monochrome mode of forming only black color or of a two to three color mode for example, the image forming process is executed on each photoconductive drum of the image forming units of necessary colors. At this time, the photoconductive drums of unnecessary image forming units are idly rotated. Then, the similar operations of primarily transferring the toner image onto the intermediate transfer belt 10 at the primary transfer portion T1 (T1Y), of secondarily transferring on the recording medium P at the secondary transfer portion T2, and of introducing to the fixing apparatus 20 are executed.

Next, a structure of the fixing apparatus 20 of the present embodiment will be schematically described with reference to FIG. 2. It is noted that FIG. 2 is a schematic structural view showing the structure of the fixing apparatus 20 of the present embodiment.

Figure 2:
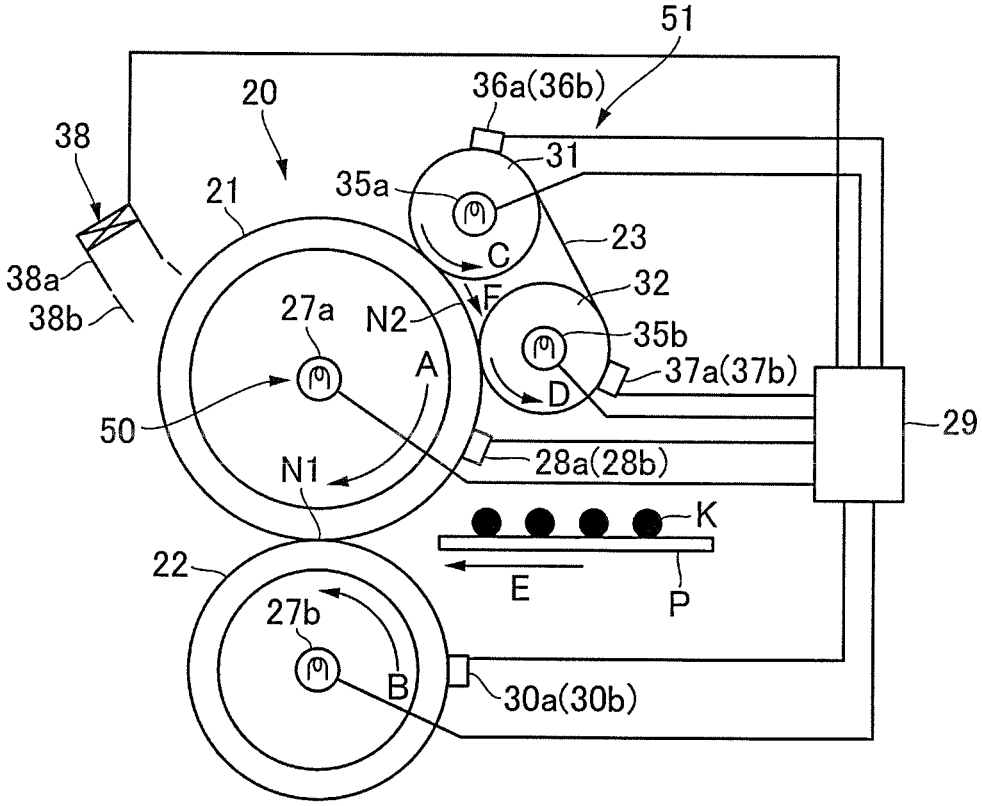
FIG. 2 is a schematic structural view showing a configuration of a fixing apparatus of the first embodiment.

As shown in FIG. 2, the fixing apparatus 20 includes a rotable fixing roller 21 configured to heat the image on the recording medium P, a pressure roller 22 as a pressure member, and an external heating belt 23, i.e., an external heating member, configured to heat the fixing roller 21 from an outside of the fixing roller 21 while in contact with the fixing roller 21. The fixing apparatus 20 also includes a cooling fan 38 driven so as to cool a predetermined region on a surface of the fixing roller 21.

The fixing apparatus 20 is configured to be able to execute a sheet feeding state of performing an image heating process of heating the toner image carried on the recording medium P by the fixing roller 21 and a stand-by state of not performing the image heating process (a state of standing by the image heating process).

During the sheet is fed, the fixing roller 21 is rotationally driven in a direction of an arrow A in FIG. 2 in a predetermined speed (peripheral speed) by a driving source not shown in a state in which the pressure roller 22 is in pressure contact. The pressure roller 22 is disposed under the fixing roller 21 so as to face the fixing roller 21 and forms a fixing nip portion N1 between the fixing roller 21 and the pressure roller 22 pressed against the fixing roller 21 under a predetermined pressure by a pressure mechanism not shown. The pressure roller 22 is in contact with an outer surface of the fixing roller 21 and driven by the fixing roller 21 in a direction of an arrow B in a predetermined speed (peripheral speed).

[Configurations of Fixing Roller and Pressure Roller]

Figure 3:
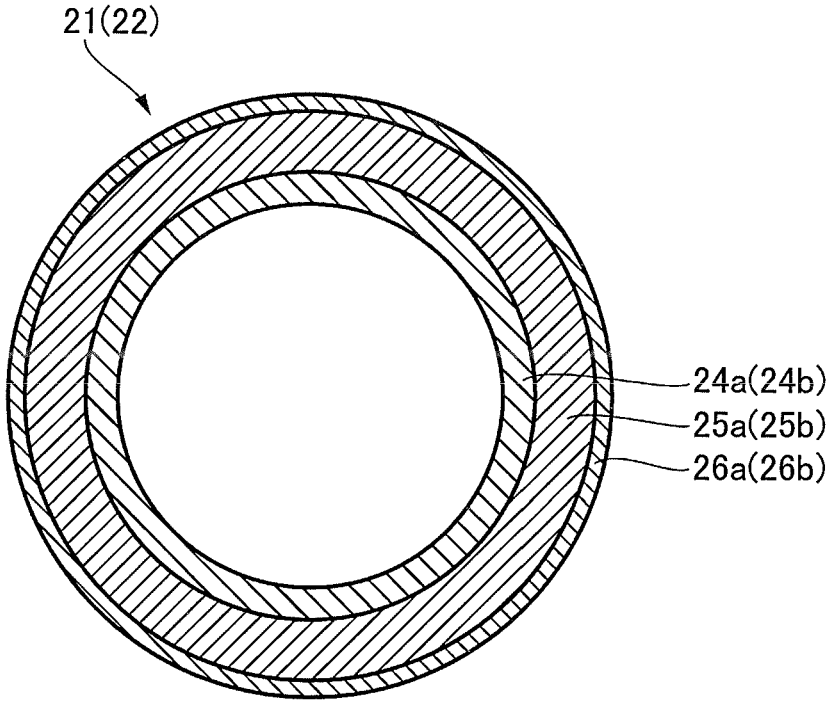
FIG. 3 is a schematic structural view showing a configuration of a fixing roller of the fixing apparatus of the first embodiment.

Next, configurations of the fixing roller 21 and the pressure roller 22 will be described below. That is, as shown in FIG. 3, the fixing roller 21 has a structure in which a cylindrical and metallic core metal 24*a*, a heat resistant elastic layer 25*a*, and a heat resistant release layer 26*a* are layered in order from an inner diameter side thereof. The pressure roller 22 also has a structure in which a cylindrical and metallic core metal 24*b*, a heat resistant elastic layer 25*b*, and a heat resistant release layer 26*b* are layered in order from an inner diameter side thereof.

The core metal 24*a* of the fixing roller 21 is made of aluminum having 74 mm in outer diameter, 6 mm in thickness, and 350 mm in length. The elastic layer 25*a* is made of silicone rubber, e.g., 20 degrees of JIS-A hardness, of 3 mm in thickness and coats an outer circumferential surface of the core metal 24*a*. The release layer 26*a* is made of fluoro-resin, e.g., a PFA tube, of 100 μm in thickness for example and coats a surface of the elastic layer 25*a* to improve toner releasability.

The core metal 24*b* of the pressure roller 22 is made of stainless steel having 54 mm in outer diameter, 5 mm in thickness, and 350 mm in length. The elastic layer 25*b* is also made of silicone rubber, e.g., 20 degrees of JIS-A hardness, of 3 mm in thickness and coats an outer circumferential surface of the core metal 24*b*. The release layer 26*a* is made of fluoro-resin, e.g., a PFA tube, of 100 μm in thickness for example and coats a surface of the elastic layer 25*b* to improve toner releasability.

As shown in FIG. 2, a halogen heater 27*a* of 1200 W of rated power for example as a heat source that generates heat as it is fed with electric power is disposed almost across a whole range in a width direction (longitudinal direction or axial direction) of the fixing roller 21 within the core metal 24*a* of the fixing roller 21. The halogen heater (fixing heater) 27*a* heats the fixing roller (image heating member) 21 from an inside of the fixing roller 21 such that an outer surface temperature (referred to simply as a "surface temperature" hereinafter) of the fixing roller 21 rises to a predetermined target temperature.

It is noted that the surface temperature of the fixing roller 21 is detected by fixing temperature detecting thermistors, i.e., image heating temperature detecting members, 28*a* and 28*b*. Then, on a basis of the detected temperature, a control portion 29 including a CPU, a ROM, a RAM and others turns ON/OFF the halogen heater 27*a* to control the surface temperature at the predetermined target temperature, e.g., 180° C.

As shown in FIG. 2, a halogen heater 27*b* of 400 W of rated power for example as a pressure member heat source that generates heat as it is fed with electric power is also disposed almost across a whole range in a width direction (longitudinal direction or axial direction) of the pressure roller 22 within the core metal 24*b* of the pressure roller 22. The halogen heater (fixing heater) 27*b* heats the pressure roller 22 from an inside of the pressure roller 22 such that an outer surface temperature of the pressure roller 22 rises to a predetermined temperature.

It is noted that the surface temperature of the pressure roller 22 is detected by thermistors, i.e., pressure member temperature detecting members, 30*a* and 30*b*. Then, on a basis of the detected temperature, the control portion 29 turns ON/OFF the halogen heater 27*b* to control the surface temperature at a predetermined target temperature, e.g., 100° C.

[Configuration of External Heating Belt]

As shown in FIG. 2, the external heating belt 23 is stretched around external heating rollers 31 and 32, i.e., belt stretching rollers. These external heating rollers 31 and 32 have cylindrical metallic, e.g., aluminum, core metals of 30 mm in outer diameter, 3 mm in thickness, and 350 mm in length. The external heating rollers 31 and 32 compose a plurality of heatable belt stretching rollers. Still further, because the external heating belt 23, i.e., the external heating member, is an endless belt wrapped around the external heating rollers 31 and 32, the external heating belt 23 can increase a quantity of heat applied to the fixing roller 21 and improve an effect in controlling the temperature of the fixing roller 21.

The external heating rollers 31 and 32 configured as described above are pressed against the fixing roller 21 together with the external heating belt 23 by an external heating contact/separation mechanism 39 (see FIG. 5) by a predetermined pressure and form an external heating nip portion N2, i.e., a second nip portion, between the external heating belt 23 and the fixing roller 21. The external heating belt 23 is rotationally driven in a direction of an arrow F with respect to the fixing roller 21 and the external heating rollers 31 and 32 are also rotationally driven in directions of arrows C and D, respectively, with respect to the fixing roller 21.

Figure 4:
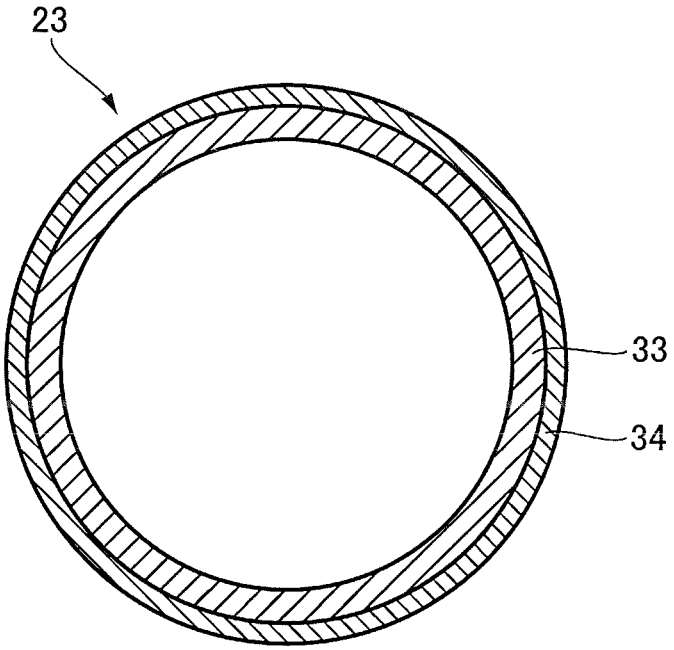
FIG. 4 is a schematic structural view showing a configuration of a pressure roller of the fixing apparatus of the first embodiment.

As shown in FIG. 4, the external heating belt 23 is configured such that an endless metallic base layer 33 and a heat resistant release layer 34 are layered in order from an inner diameter side thereof. The base layer 33 is made of stainless steel having 204 mm in inner diameter, 50 μm in thickness, and 350 mm in length. The release layer 34 is formed of fluoro-resin, e.g., a PFA tube, of 20 μm in thickness and coats an outer circumferential surface of the base layer 33 to improve toner reliability.

Still further, as shown in FIG. 2, the external heating rollers 31 and 32 are provided with halogen heaters 35*a* and 35*b* therein, respectively. That is, the halogen heaters 35*a* and 35*b* of 800 W of rated power for example are disposed almost across a whole range in a width direction (longitudinal direction or axial direction) of the external heating rollers 31 and 32, respectively, as heating portions that generate heat as they are fed with electric power. These halogen heaters 35*a* and 35*b* heat the external heating belt 23 from an inside of the belt 23 such that a surface temperature of the external heating belt 23 rises to a predetermined target temperature.

External heating temperature detecting thermistors 36*a* and 36*b*, i.e., external heating temperature detecting members, configured to detect the surface temperature of the external heating belt 23 are disposed at positions facing the external heating roller 31. Still further, external heating temperature detecting thermistors 37*a* and 37*b*, i.e., external heating temperature detecting members, configured to detect the surface temperature of the external heating belt 23 are disposed at positions facing the external heating roller 32. The surface temperature of the external heating belt 23 is detected by these external heating temperature detecting thermistors 36*a*, 36*b*, 37*a* and 37*b*.

As shown in FIGS. 1 and 2, the halogen heaters 27*a*, 27*b*, 35*a* and 35*b* and the external heating temperature detecting thermistors 36*a*, 36*b*, 37*a* and 37*b* are connected to a control portion 29 provided in the apparatus body of the image forming apparatus 1. The control portion 29 controls ON/OFF of the halogen heater 35*a* based on the temperatures detected by the external heating temperature detecting thermistors 36*a* and 36*b*, and controls ON/OFF of the halogen heater 35*b* based on the temperatures detected by the external heating temperature detecting thermistors 37*a* and 37*b*.

Thereby, the surface temperature of the external heating belt 23 is controlled at the predetermined temperature, e.g., 210° C. That is, the control portion 29 increases/decreases the quantity of heat applied to the fixing belt 21 by controlling the external heating belt 23, i.e., the external heating member, at the preset temperature based on the temperatures detected by the external heating temperature detecting thermistors 36*a*, 36*b*, 37*a* and 37*b*. That is, in this case, it is possible to increase/decrease the applied quantity of heat adequately by controlling the temperature of the external heating belt 23.

The control portion 29 also increases/decreases the quantity of heat applied to the fixing roller 21 by bringing the external heating belt 23 in contact with/separate from the fixing roller 21. In this case, it is possible to increase/decrease the applied quantity of heat adequately by attaching/detaching the external heating belt 23 to/from the fixing roller 21.

It is noted that although the control portion 29 is provided within the apparatus body of the image forming apparatus 1 in the present embodiment, the invention is not limited to such a case and a control portion of the halogen heaters 27*a*, 27*b*, and 35*a* and 35*b* related to the functions of the fixing apparatus 20 may be provided separately in the fixing apparatus 20. It is also possible to configure such that the control portion separately provided in the fixing apparatus 20 is used as a control portion of the image forming apparatus 1 of the invention.

Still further, although the external heating belt 23 is employed as a mechanism of improving the heating performance in the present embodiment, the invention is not limited to such a configuration and may be configured such that an external heating roller is in contact with the fixing roller 21. Although the external heating belt 23 is also stretched around the two external heating rollers 31 and 32 in the present embodiment, the invention is not limited to such a configuration and may be configured such that the external heating belt 23 is stretched around three or more support rollers (external heating rollers) by providing another tension roller as necessary.

[Disposition of Surface Temperature Detecting Thermistors]

Next, the thermistors detecting the respective surface temperatures of the fixing roller 21, the pressure roller 22 and the external heating belt 23 will be detailed below.

In the case of the present embodiment, the thermistors detecting the respective surface temperatures are disposed at two places in the width direction (the longitudinal direction or a direction orthogonal to a direction in which the recording medium is fed) of each roller. That is, the thermistors 28*a*, 30*a*, 36*a* and 37*a*, i.e., main thermistors, are disposed at widthwise center parts of the respective rollers and the thermistors 28*b*, 30*b*, 36*b* and 37*b*, i.e., sub-thermistors, are disposed at widthwise one ends of the respective rollers.

While the thermistors 28*a*, 30*a*, 36*a* and 37*a* are disposed at the widthwise center parts of the corresponding rollers, they may be disposed at a position deviated from the widthwise center so long as the position is located within a range of a width of a smallest-size sheet (width of a smallest-size recording medium). Meanwhile, the thermistors 28*b*, 30*b*, 36*b* and 37*b* disposed at the widthwise one ends of the respective corresponding rollers may be disposed at any location in an area (non-sheet feed portion) deviated from an area where a maximum-size recording medium passes through or in a region corresponding to that area (region corresponding to the non-sheet feed portion).

[Configuration of Cooling Fan]

The fixing apparatus 20 is provided with a cooling fan 38 configured to cool a predetermined region of the fixing roller 21 in the present embodiment. As shown in FIG. 2, the cooling fan 38 includes a fan body 38*a* and a duct 38*b* leading an air blast (air) from the fan body 38*a* to the predetermined region of the fixing roller 21. Because the image forming apparatus 1 of the present embodiment is configured to feed sheets on a central reference base, the cooling fans 38 are disposed at positions facing widthwise both ends (in the longitudinal or axial direction of the roller, a front and back direction in FIG. 2) of the fixing roller 21.

[Configuration of Control Portion and Manipulation Portion]

Figure 5:
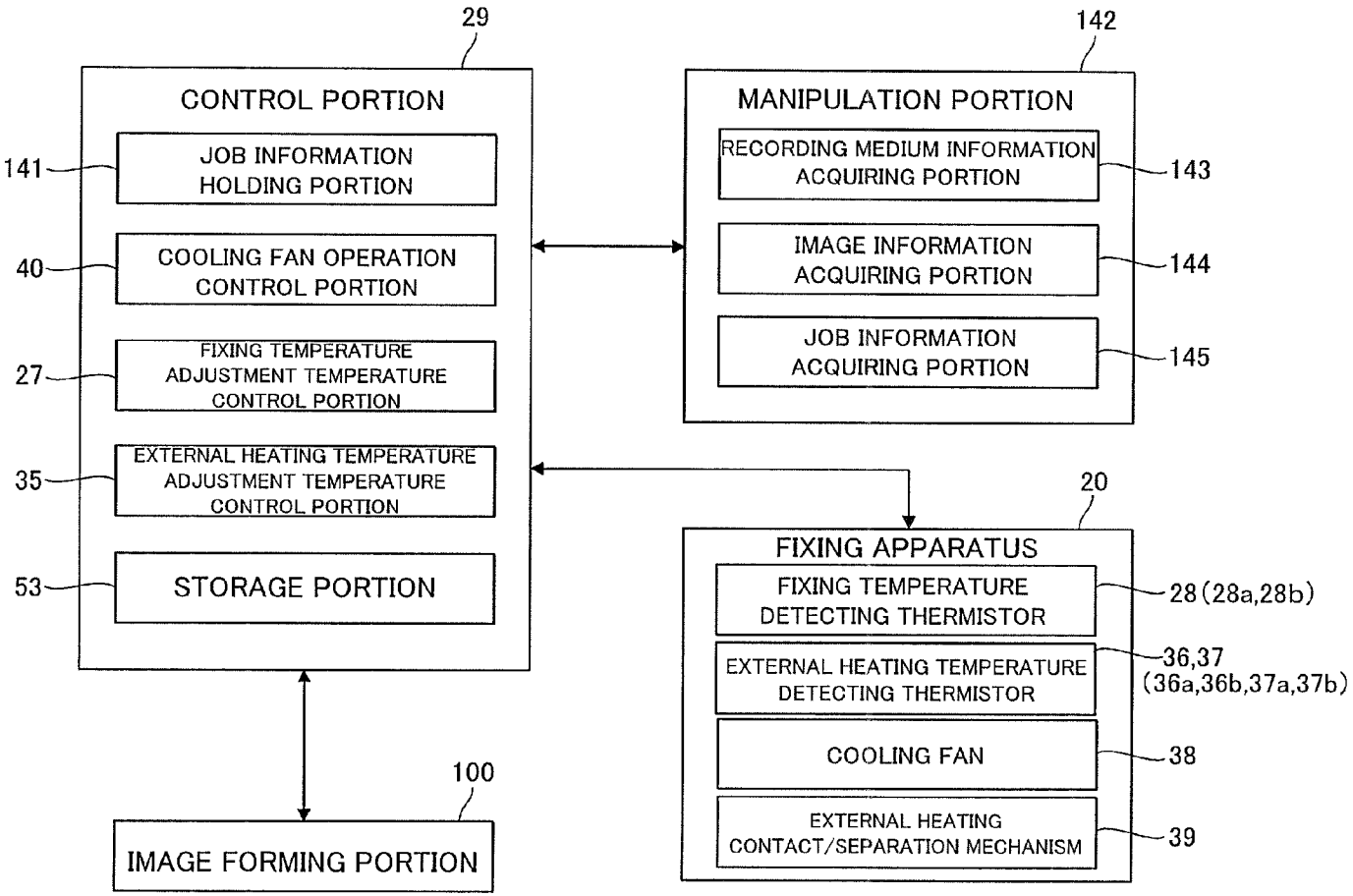
FIG. 5 is a block diagram showing a control circuit of the first embodiment.

As shown in FIG. 5, the image forming apparatus 1 is provided with the control portion 29, and a manipulation portion 142, the image forming portion 100, and the fixing apparatus 20 described above, respectively connected to the control portion 29. The manipulation portion 142 functions as an interface when a user accesses to the apparatus. The control portion 29 manages overall operations of the image forming apparatus 1 by integrating control systems among the respective units while monitoring and controlling operations of the respective units in the apparatus.

The manipulation portion 142 includes a recording medium information acquiring portion 143, an image information acquiring portion 144, and a job information acquiring portion 145. The recording medium information acquiring portion 143 acquires recording medium information such as basis weight and surface nature as print job information inputted by the user.

The image information acquiring portion 144 acquires basic preset information of image information such as density. The job information acquiring portion 145 acquires job information such as a number of prints of a job, information whether double face or single face printing, and a so-called "media consolidated job" of continuously printing by switching types of recording media.

The fixing apparatus 20 includes the fixing temperature detecting thermistors 28 (28*a*, 28*b*), the external heating temperature detecting thermistors 36 and 37 (36*a*, 36*b*, 37*a* and 37*b*), and the cooling fan 38. The fixing apparatus 20 also includes the external heating contact/separation mechanism 39 configured to bring the external heating roller (external heating member) 23 in contact/separate (attach/detach) with/from the fixing roller (image heating member) 21. The external heating contact/separation mechanism 39 is constructed by using a mechanical mechanism, e.g., a cam mechanism.

The control portion 29 executes controls of first and second modes as described later by receiving a consolidated job in which a recording medium (thick sheet) P whose basis weight is a predetermined value or more and a recording medium (thin sheet) P whose basis weight is less than the predetermined value are sent sequentially in a relationship of a preceding job and a succeeding job. This operation will be described in detail. It is noted that the "job" in the present embodiment is data related to printing and converted into a form processable by the control portion 29, and includes not only print commands and print data to the control portion 29 described above, but also information such as a number of sheets to be printed and types of sheets. "Preceding/succeeding" of the preceding and succeeding jobs indicate a sequence of jobs of printing processed by the control portion 29, and the succeeding job is a job of printing processed by the control portion 29 after the preceding job.

In addition, the consolidated job means a group of jobs in which types, e.g., basis weights, of recording media are switched between the preceding and succeeding jobs during which the printing processes are continuously executed. By receiving the consolidated job, the control portion 29 controls the image forming portion 100 and the fixing apparatus 20 to form and fix a toner image on a recording medium of a type of the preceding job and then to form and fix a toner image on a recording medium of a type of the succeeding job different from the recording medium of the type of the preceding job. The consolidated job may be inputted to the control portion 29 either in a form of integral data of the preceding and succeeding job or in a form of different data of the preceding job and the succeeding job. For instance, even if the preceding job and the succeeding job formed separately by an external personal computer or the like are inputted to the control portion 29, respectively, such preceding and succeeding jobs are buffered by the storage portion 53 of the control portion 29, so that the control portion 29 can recognize that the succeeding job of printing the recording medium whose type is different from that of the preceding job continues after the preceding job.

In a case where a plurality of sheets is printed, each of the preceding job and the succeeding job may be also formed in the form of the integral data or of the separate data in the same manner. That is, in a case where images are printed to a plurality of recording media of a same type, a job is formed per sheet of the recording media, and the preceding job or the succeeding job may be formed by an aggregate of the jobs per each sheet of the recording media. Specifically, a sole job of instructing to form an image on a recording medium of a type of the succeeding job of one sheet may be inputted to the control portion 29 by a plural times in succession after when a sole job of instructing to form an image on a recording medium of a type of the preceding job of one sheet is inputted by a plural times. Even in such a case, the control portion 29 performs the printing processes sequentially while buffering these continuously inputted jobs, so that the control portion 29 can recognize that these jobs are consolidated job in which the recording medium of the type of the succeeding job is printed after printing a plurality of the recording media of the type of the preceding job on a way of performing the printing process on the recording media of the type of the preceding job. It is noted that the predetermined value descried above is set at 150 g/m$^2$ for example in the following embodiment, and the recording medium (thick sheet) P whose basis weight is 150 g/m$^2$ or more will be referred as a first recording medium and the recording medium (thin sheet) P whose basis weight is less than 150 g/m$^2$ will be referred to as a second recording medium.

The first mode described above is a mode of controlling the temperature detected by the fixing temperature detecting thermistors (image heating temperature detecting members) 28*a* and 28*b* under a predetermined control condition at a target temperature of the preceding job in executing the preceding job in the consolidated job in which the first and second recording media are sent in a relationship of the preceding job and succeeding job. The second mode described above is a mode of switching the predetermined control condition while maintaining a setting of the target temperature of the temperature detected by the fixing temperature detecting thermistors in the middle of processing the preceding job in the consolidated job in which the first and second recording media are sent in a relationship of the preceding and succeeding jobs.

In the case of the control where the recording media are switched from the thick sheet to the thin sheet as described above, the control portion 29 stops to heat by the halogen heater (heat source) 27*a*, increases a quantity of heat applied by the external heating belt 23, and starts to operate the cooling fan 38 in the middle of processing of the preceding job in the second mode.

The control portion 29 also executes third and fourth modes as described below by receiving a consolidated job in which the recording medium P (thin sheet) whose basis weight is less than the predetermined value and the recording medium P (thick sheet) whose basis weight is the predetermined value or more are sent sequentially in a relationship of preceding and succeeding jobs. The third mode is a mode of controlling the temperature detected by the fixing temperature detecting thermistors 28*a* and 28*b* under a predetermined control condition at the target temperature of the preceding job in the consolidated job in which the second and first recording media are sent in a relationship of the preceding and succeeding jobs. The fourth mode is a mode of switching the predetermined control condition while maintaining a setting of the target temperature in the middle of processing the preceding job in the consolidated job in which the second and first recording media are sent in a relationship of the preceding and succeeding jobs.

In the case of the control in which the recording media are switched from the thin sheet to the thick sheet as described above, the control portion 29 increases a quantity of heat applied by the halogen heater 27*a*, implements a heating operation by the external heating belt 23, and starts to operate the cooling fan 38 in the middle of processing of the preceding job in the fourth mode.

Then, when the preceding job is finished in the second or the fourth mode, the control portion 29 controls such that the external heating belt 23 is separated from the fixing roller 21 by the external heating contact/separation mechanism 39. Further, when the temperature detected by the fixing temperature detecting thermistors 28*a* and 28*b* reaches the target temperature of the succeeding job, the control portion 29 controls such that the cooling fan 38 stops its operation and the succeeding job is executed.

Still further, when the preceding job is finished in the second or fourth mode, the control portion 29 controls such that the external heating belt 23 is separated from the fixing roller 21 by the external heating contact/separation mechanism 39 and the operation of the cooling fan 38 is stopped. The control portion 29 also controls such that the succeeding job is executed when the temperature detected by the fixing temperature detecting thermistors 28*a* and 28*b* reaches the target temperature of the succeeding job.

That is, in the present embodiment, the halogen heater 27*a* composes a first temperature adjustment portion 50 that adjusts the surface temperature of the image heating member from an inside of the image heating member, and the external heating belt 23, the external heating contact/separation mechanism 39, and the cooling fan 38 compose a second temperature adjustment portion 51 that adjusts the surface temperature of the image heating member from an outside of the image heating member. Then, in the second and fourth modes, at least either one recording medium among the first recording medium, e.g., the thick sheet, described above and the second recording medium, e.g., the thin sheet, described above whose basis weight is smaller than that of the first recording medium is heated in succession after heating a plurality of the other recording media. Here, the control portion 29 executes a preliminary control in the middle of heating the plurality of the other recording media while maintaining a setting of a target temperature of a temperature detected by the image heating temperature detecting member at a target temperature corresponding to other recording medium such that a quantity of heat supplied from the first temperature adjustment portion 50 to the image heating member is changed based on a target temperature of a temperature detected by the image heating temperature detecting member corresponding to the one recording medium and the second temperature adjustment portion 51 is controlled such that the temperature detected by the image heating temperature detecting member is adjusted to the target temperature corresponding to the other recording medium.

More specifically, the second mode described above is a preliminary control (temperature adjustment Down preliminary control) in a case of heating the second recording medium after heating a plurality of the first recording media, and the fourth mode is a preliminary control (temperature adjustment Up preliminary control) in a case of heating the first recording medium after heating a plurality of the second recording media in the present embodiment.

In other words, the control portion 29 is configured to be able to execute the temperature adjustment Down preliminary control in the middle of heating of the plurality of the first recording media as the preliminary control while maintaining the setting of the target temperature of the temperature detected by the image heating temperature detecting member at a target temperature corresponding to the first recording medium by reducing the quantity of heat supplied from the first temperature adjustment portion to the image heating member and by controlling the second temperature adjustment portion such that the temperature detected by the image heating temperature detecting member is adjusted to the target temperature corresponding to the first recording medium.

Still further, the control portion 29 is configured to be able to execute the temperature adjustment Up preliminary control in the middle of heating the plurality of the second recording media as the preliminary control while maintaining the setting of the target temperature of the temperature detected by the image heating temperature detecting member at a target temperature corresponding to the second recording medium by increasing the quantity of heat supplied from the first temperature adjustment portion to the image heating member and by controlling the second temperature adjustment portion such that the temperature detected by the image heating temperature detecting member is adjusted to the target temperature corresponding to the second recording medium.

It is noted that the increase of the supplied quantity of heat includes a case of adding a quantity of heat from a state in which no heat quantity is supplied and the reduction of the supplied quantity of heat includes a case of stopping to supply the heat quantity from a state in which the heat quantity is supplied. Still further, while the control portion 29 is capable of executing both of the temperature adjustment Down preliminary control and the temperature adjustment Up preliminary control in the present embodiment, the control portion 29 may be configured so as to execute only the temperature adjustment Down preliminary control or the temperature adjustment Up preliminary control. Also, the first temperature adjustment portion 50 may be not only halogen heater but also other heat sources, for example, an induction heating type heat source and the like. Still further, the second temperature adjustment portion 51 may include a heat source of a radiation heating type, an induction heating type, and the like, and may include a cooling fan cooling a surface of the heating member. In addition, the print job information may be inputted to the image forming apparatus 1 from an external personal computer or the like beside the manipulation portion 142. The information inputted to the image forming apparatus 1 is temporarily stored in the job information holding portion 141 provided in the control portion 29 and is utilized as control parameters of operations of respective units in executing the job.

[Basic Operation Flow while Feeding Sheets]

Next, specific contents of the control of the control portion 29 will be described below in accordance to a flow of fixing operations carried out in feeding sheets. It is noted that the respective rollers of the fixing apparatus 20 constructed as described above are made into pressure contact/separate with/from each other by pressing and separating portions not shown or by the external heating contact/separation mechanism 39 during a stand-by time and a sheet feeding time.

During the stand-by time, the pressure roller 22 the external heating rollers 31 and 32, and the external heating belt 23 are separated from the fixing roller 21 by the separating portion not shown in order to prevent deformation or strain of the elastic layer 25*a* of the fixing roller 21 and the elastic layer 25*b* of the pressure roller 22. Meanwhile, in feeding the sheets, i.e., during the operation of fixing (heating) the image on the recording medium, the pressure roller 22 is pressed against the fixing roller 21 by the pressing portion not shown and the external heating rollers 31 and 32 and the external heating belt 23 are pressed against the fixing roller 21 by the external heating contact/separation mechanism 39.

Still further, as described above, the fixing apparatus 20 fixes the toner image formed on the recording medium P by the image forming portion 100 to the recording medium P. That is, as shown in FIG. 2, the recording medium P carrying the toner image K is conveyed in a direction of an arrow E and is introduced into the fixing nip portion N1 of the fixing apparatus 20.

The recording medium P is heated and pressed in passing through the fixing nip portion N1 and the toner image K is fixed to the recording medium P. At this time, a heat is seized from a region on the surface of the fixing roller 21 by the recording medium P at the fixing nip portion N1, and the region where the temperature has dropped rises to a predetermined temperature again by being heated by a quantity of heat from the halogen heater 27*a* and a quantity of heat from the external heating nip portion N2. The fixing operation is carried out by repeatedly applying the heat to the recording medium P at the fixing nip portion N1 again after that.

Meanwhile, a region of the external heating belt 23 whose temperature has dropped as its heat was seized by the fixing roller 21 at the external heating nip portion N2 rises to a predetermined temperature by being heated at a part in contact with the external heating roller 32 and at a part in contact with the external heating roller 31. After that, the fixing operation is carried out by repeatedly applying the heat to the fixing roller 21 at the external heating nip portion N2.

Here, if the respective rollers are left in pressure contact without separating from each other during the stand-by time, there is such a possibility that the deformation and strain of the elastic layers in the fixing nip portion N1 and the external heating nip portion N2 remain even in prints and degrade a quality of images by causing a lateral stripe and a luster stripe (uneven brightness). Therefore, the respective rollers are separated during the stand-by time to prevent such problems.

[Setting of Temperature Adjustment Temperature (Target Temperature) Per Medium]

In the present embodiment, the target temperature of the fixing roller 21 in feeding the recording medium (thin sheet) P whose basis weight is less than the predetermined value is set at 130° C. and the target temperature of the external heating belt 23 is set at 170° C. Still further, the target temperature of the fixing roller 21 in feeding the recording medium (thick sheet) P whose basis weight is the predetermined value or more is set at 170° C. and the target temperature of the external heating belt 23 is set at 210° C.

Here, the predetermined value of the basis weight is defined as follows. That is, the recording medium (media) whose basis weight is 150 g/m$^2$ or more is the thick sheet, and the recording medium whose basis weight is less than 150 g/m$^2$ is the thin sheet.

Still further, the target temperature is set such that the thicker the sheet whose media heat capacity is large, the more the quantity of heat supplied is in order to achieve both good image properties, e.g., toner offset fixability and glossiness of the image, and conveyance, e.g., wrinkles, waviness of the sheet, and fixing and separation. If the quantity of supplied heat is large in the thin sheet, the sheet is apt to cause wrinkles and waviness of the sheet, so that the target temperature of the thin sheet is set low. If the quantity of supplied heat is small in the thick sheet, the sheet is apt to cause toner offset peeling and degradation of glossiness of images and others, so that the target temperature of the thick sheet is set high.

[Control in Switching Media from Thick Sheet to Thin Sheet]

By the way, it takes a time to lower the surface temperature of the fixing roller 21 from 170° C. to 130° C. in a case of the consolidated job in which thin sheets are fed after continuously feeding thick sheets, so that a stand-by time is prolonged, dropping a total productivity. In particular, the halogen heater 27*a* is substantially kept ON to suppress a drop of the surface temperature of the fixing roller 21 while continuously feeding the thick sheets, so that a core metal temperature of the fixing roller 21 rises. Accordingly, the temperature of the fixing roller 21 hardly drops after continuously feeding the thick sheets.

Then, in the present embodiment, the control portion 29 controls such that the heating of the halogen heater 27*a* is stopped, the quantity of heat applied by the external heating belt 23 is increased, and the operation of the cooling fan 38 is started in the middle of processing of the preceding job in the second mode. That is, the control portion 29 turns OFF the halogen heater 27*a* and increases the temperature adjustment temperature of the external heating belt 23 from 210° C. to 220° C. to increase a quantity of heat supplied from the external heating belt 23 to the surface of the fixing roller 21 before entering the fixing nip portion N1. Thereby, the control portion 29 executes a "consolidated job control in processing the thick sheet" in the second mode. This control is executed to suppress the increase of the temperature of the core metal 24*a* (see FIG. 3) of the fixing roller 21 while maintaining the surface temperature of the fixing roller 21. The control portion 29 also cools the fixing roller 21 after passing through the fixing nip portion N1 by blowing air by turning the cooling fan 38 ON.

This arrangement makes it possible to suppress the core metal temperature from increasing and to readily lower the temperature of the fixing roller 21 in switching the temperature adjustment temperature to that of the next thin sheet feeding job by executing the consolidated job control in processing the thick sheet in the state in which the temperature of the core metal 24*a* is fully high.

It is preferable to implement the consolidated job control in processing the thick sheet in the second mode in the state in which the core metal temperature is fully high as described above. During an initial period in feeding the thick sheets, e.g., 1 to 30$^{-th}$ sheets to be printed, the temperature of the core metal 24*a* is not fully high and the temperature of the fixing roller 21 drops significantly because a turn-on rate or the halogen heater 27*a* is low during a stand-by time before that job. If the consolidated job control in processing the thick sheet is carried out in this state, there is a possibility that the temperature of the fixing roller 21 drops more significantly, the toner offset fixability becomes insufficient, and an image quality is dropped. Therefore, the consolidated job control in processing the thick sheet is executed on and after $31^{-th}$ print sheets by which the core metal temperature fully rises in the present embodiment.

Even on and after the $31^{-th}$ sheets, there is a possibility that the core metal temperature drops more than necessary and the image quality drops if the consolidated job control in processing the thick sheet is started in a state in which a large number of thick sheets to be printed is left, e.g., 100 sheets. Accordingly, the consolidated job control in processing the thick sheet is executed on and after $20^{-th}$ sheets left to be printed by which the drop of the core metal temperature does not occur by the consolidated job control in processing the thick sheet in the present embodiment. Still further, the present embodiment is configured so as not to carry out the consolidated job control in processing the thick sheet when a number of thick sheets to be printed is 30 sheets or less.

[Control in Switching Media from Thin Sheet to Thick Sheet]

Still further, it takes a time to rise the surface temperature of the fixing roller 21 from 130° C. to 170° C. in a case of the consolidated job in which thick sheets are fed after continuously feeding thin sheets, so that a stand-by time occurs and a total productivity drops. Because a quantity of heat is fully supplied in the case of the thin sheets, the surface temperature of the fixing roller 21 hardly drops and an OFF state of the halogen heater 27*a* lasts long, so that a temperature of the core metal 24*a* of the fixing roller 21 is low. Accordingly, the temperature of the fixing roller 21 is in a state of being hardly increases after continuously feeding the thin sheets.

Then, in the present embodiment, the control portion 29 controls such that the quantity of heat applied by the halogen heater 27*a* is increased, the heating operation of the external heating belt 23 is carried out, and the operation of the cooling fan 38 is started in the middle of processing of the preceding job in the fourth mode. That is, the control portion 29 turns the halogen heater 27*a* ON while increasing the target temperature of the fixing roller 21 from 130° C. to 140° C. and turning the cooling fan 38 ON. The control portion 29 also executes a "consolidated job control in processing the thin sheet" in the fourth mode. This control is executed to suppress the core metal temperature of the fixing roller 21 from being lowered while maintaining the surface temperature of the fixing roller 21. The control portion 29 also keeps the quantity of heat supplied from the external heating belt 23 to the surface of the fixing roller 21 before entering the fixing nip portion N1 while maintaining the target temperature of the external heating belt 23 at 170° C.

Thus, the execution of the consolidated job control in processing the thin sheet in the state in which the core metal temperature is relatively low makes it possible to suppress the core metal temperature from being lowered from the temperature at the point of time of the execution and to readily increase the temperature of the fixing roller 21 in switching the temperature adjustment temperature to that of the next thick sheet feeding job.

It is preferable to implement the consolidated job control in processing the thin sheet in the fourth mode in the state in which the core metal temperature is relatively low as described above. During an initial period in feeding the thin sheets, e.g., 1 to $20^{-th}$ print sheets, the temperature of the core metal 24*a* is not fully high because a turn-on rate of the halogen heater 27*a* is low during the stand-by state before that and the core metal temperature rises as the ON state of the halogen heater 27*a* lasts long. If the consolidated job control in processing the thin sheet is carried out in this state, there is a possibility that the increase of the temperature of the fixing roller 21 becomes significant, so that the conveyance drops and uneven glossiness or the like occurs due to wrinkles and inferior separation. Therefore, the consolidated job control in processing the thin sheet is executed on and after $21^{-th}$ print sheets by which the core metal temperature is relatively lowered in the present embodiment.

Even on and after the $21^{-th}$ sheets, there is a possibility that the core metal temperature rises more than necessary and the image quality drops if the consolidated job control in processing the thin sheet is started in a state in which a large number of thin sheets to be printed is left, e.g., 100 sheets. Accordingly, the consolidated job control in processing the thin sheet is executed on and after $20^{-th}$ sheets left to be printed by which the drop of the core metal temperature does not occur by the consolidated job control in processing the thin sheet in the present embodiment. Still further, the present embodiment is configured so as not to carry out the consolidated job control in processing the thin sheet when a number of thin sheets to be printed is 20 sheets or less.

[Flow of Operations in Temperature Adjustment Down Mode from Thick Sheet to Thin Sheet]

Next, a flow of the controls of the temperature adjustment temperature (target temperature) of the fixing roller 21 and of the temperature adjustment temperature of the external heating belt 23, and of operations of the cooling fan 38 in the media consolidated job of the present embodiment will be explained. FIG. 6 is a flowchart showing the flow of these operations.

The flow of operations actually carried out will be explained by exemplifying a temperature adjustment Down mode in which 100 thick sheets having 300 g/m$^2$ of basis weight are switched to 100 thin sheets having 70 g/m$^2$ of basis weight by using the flowchart shown in FIG. 6. Thus, the thick sheets (first recording medium) having 300 g/m$^2$ or more of basis weight and the thin sheets (second recording medium) having less than 70 g/m$^2$ of basis weight are used here.

At first, the control portion 29 receives the consolidated job in which the thick and thin sheets are sent sequentially in a relationship of a preceding job and a succeeding job in Step S101. The control portion 29 accepts switching of the recording media while executing the preceding job (during the preceding job). The control portion 29 judges switching of the recording media based on the recording medium information, image information and job information stored in the job information holding portion 141. Here, it is supposed that the control portion 29 accepts the job of processing 100 thin sheets having 70 g/m$^2$ of basis weight, i.e., the succeeding job, while processing a $50^{-th}$ print of the job of processing 100 thick sheets having 300 g/m$^2$ of basis weight, i.e., the preceding job.

It is noted that the control portion 29 processes as follows even when the control portion 29 accepts "the media consolidated job of processing the 100 thick sheets having 300 g/m$^2$ of basis weight+the 100 thin sheets having 70 g/m$^2$ of basis weight" as a batch job for example. That is, it is supposed that the control portion 29 accepts the succeeding job while processing a first print of the preceding job, where the 100 thick sheets having 300 g/m$^2$ of basis weight are processed in the preceding job and the 100 thin sheets having 70 g/m$^2$ of basis weight are processed in the succeeding job.

In Step S102, the control portion 29 judges whether or not it is necessary to switch the temperature adjustment based on fixing temperature adjustment temperatures of the preceding job and the succeeding job calculated from the recording medium information on basis weights and surface natures. Ina case where the control portion 29 judges that it is necessary to switch the temperature adjustment as a result, the control portion 29 advances the process to Step S103 to execute the second mode of switching a predetermined control condition while maintain a target temperature in the preceding job while processing the preceding job. Meanwhile, in a case where the control portion 29 judges that it is unnecessary to switch the temperature adjustment, the control portion 29 advances the process to Step S116 to execute the first mode of controlling the temperature detected by the fixing temperature detecting thermistors 28*a* and 28*b* to the target temperature of the preceding job under the predetermined control condition.

In Step S103, the control portion 29 judges whether the temperature adjustment Down mode or the temperature adjustment Up mode should be carried out on the fixing temperature adjustment temperature of the preceding job. Here, because the temperature of the thin sheet in the succeeding job is 130° C. with respect to the temperature of the thick sheet in the preceding job of 170° C., the control portion 29 judges that the temperature adjustment Down mode should be carried out. Accordingly, on and after Step S104, the control portion 29 separates the external heating belt 23 from the fixing roller 21 when the preceding job is finished in the second mode and stops the operation of the cooling fan 38 when the detected temperature of the fixing temperature detecting thermistors 28*a* and 28*b* reaches the target temperature of the succeeding job. Then, the control portion 29 executes the succeeding job.

That is, in Step S104, the control portion 29 judges whether or not a remaining number of sheets to be printed N1 of the preceding job is N1≤20. Here, because a number of remaining sheets is 100−50=50 (sheets) at a point of time when the control portion 29 recognizes the succeeding job on a $50^{-th}$ sheet, the control portion 29 judges that N1>20 sheets. Accordingly, the control portion 29 advances to Step S105 after feeding an $80^{-th}$ thick sheet of the preceding job where N1≤20.

In Step S105, the control portion 29 judges whether or not a number of accumulated fed sheets N2 of the preceding job is N2>30 (sheets). Here, because the process does not advance to Step S105 until when the $80^{-th}$ sheet is fed after recognizing the succeeding job on the $50^{-th}$ sheet, the control portion 29 judges that N2>30 (sheets). Accordingly, the control portion 29 advances the process to Step S106.

Here, the temperature of the external heating belt 23 is controlled at a preset temperature by the control portion 29 based on the temperature detected by the external heating temperature detecting thermistors 36*a*, 36*b*, 37*a* and 37*b*. Then, in Step S106, the control portion 29 controls the fixing temperature adjustment temperature control portion 27 and the external heating temperature adjustment temperature control portion 35 (see FIG. 5) such that the externally heated temperature adjustment by the external heating belt 23 rises (increases) and the fixing temperature adjustment by the fixing roller 21 is turned OFF. Here, the externally heated temperature adjustment temperature is increased from 210° C. to 220° C.

In succession, the control portion 29 controls the cooling fan operation control portion 40 (see FIG. 5) such that the cooling fan 38 is turned ON in Step S107.

In Step S108, the control portion 29 judges whether or not the sheets of the preceding job have been finished to be fed. Here, the control portion 29 judges that the feed of the sheets of the preceding job has been finished in a stage when the 100 sheets have been fed, so that the control portion 29 advances the process to Step S109.

In Step S109, the control portion 29 controls the external heating contact/separation mechanism 39 to separate (detach) the external heating belt 23 from the fixing roller 21.

In Step S110, the control portion 29 judges whether or not temperatures of the external heating belt 23 and the fixing roller 21 have reached the temperature adjustment temperature (target temperature) of the succeeding job. Here, because the temperature adjustment temperature of the fixing roller of the succeeding job is 130° C. and the temperature adjustment temperature of the external heating belt is 170° C., the control portion 29 advances the process to Step S111 in a stage when the temperature adjustment temperature of the fixing roller reaches 130° C. and the temperature adjustment temperature of the external heating belt reaches 170° C.

In Step S111, the control portion 29 controls the cooling fan operation control portion 40 so as to turn OFF the cooling fan 38.

In Step S120, the control portion 29 starts to process the thin sheets whose basis weight is 70 g/m$^2$ of the succeeding job.

Figure 7:
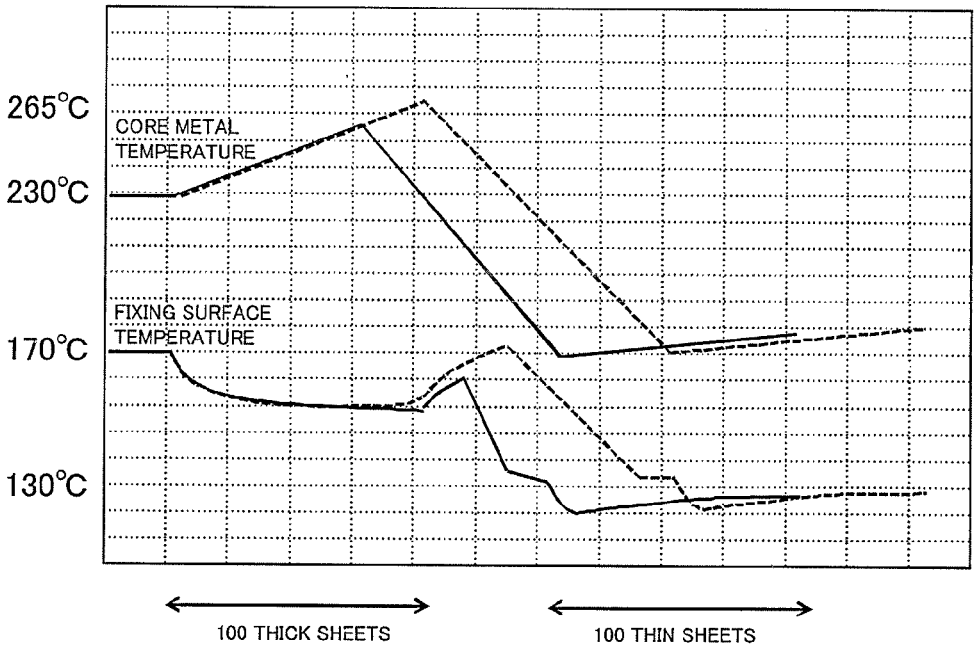
FIG. 7 is a graph showing transitions of temperatures of a surface and a core metal of the fixing roller in an operation flow during a temperature adjustment Down mode of the first embodiment.

FIG. 7 is a graph showing transitions of the temperatures of the surface of the fixing roller 21 and of the core metal of the fixing roller 21 in the operation flow during the temperature adjustment Down mode described above. Solid lines in the graph indicate the transitions of the temperatures when the job of switching from the 100 thick sheets of A4 size having 300 g/m$^2$ of basis weight to the 100 thin sheets of A4 size having 70 g/m$^2$ of basis weight was carried out from the stand-by state. Broken lines indicate transitions of temperatures in a conventional case where the switching job is carried out without employing the present invention.

It can be seen from FIG. 7 that while the temperature of the core metal 24*a* of the fixing roller 21 tends to increase in a state in which the fixing temperature adjustment temperature is maintained (turned ON) at 170° C. while feeding the sheets, the temperature gradually drops when the consolidated job control in processing the thick sheet is carried out on the $80^{-th}$ sheet by using the present embodiment. According to the temperature adjustment Down mode of the present embodiment, the core metal temperature at a point of time when the preceding job (thick sheet job) is finished is 230° C. and is low by 35° C. as compared to 265° C. of the conventional example.

Figure 8:
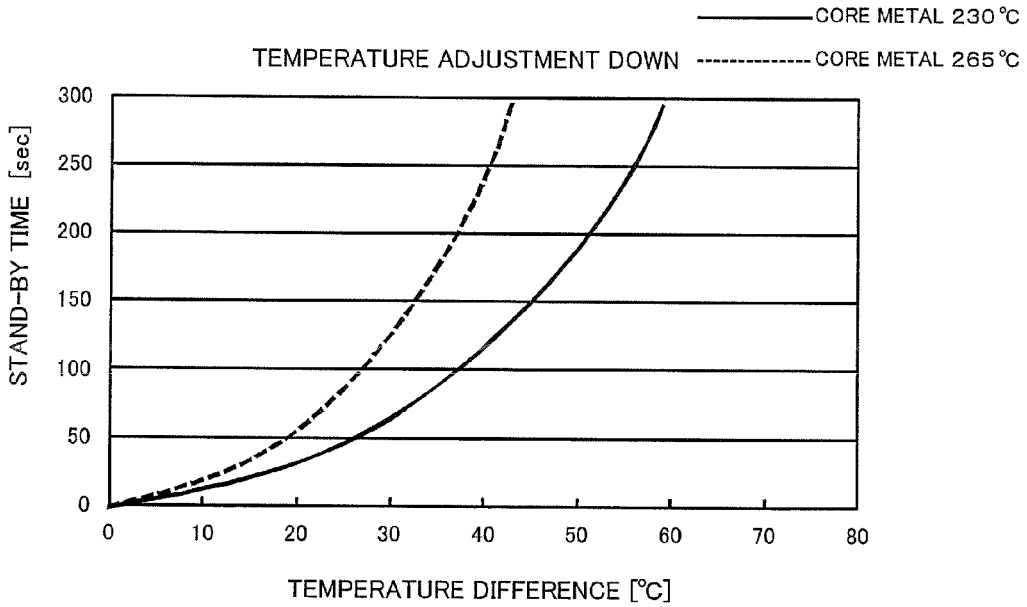
FIG. 8 is a graph indicating a time required to lower a temperature difference Δ in the first embodiment.

FIG. 8 is a graph indicating a time required to lower a temperature difference Δ. A solid line in the graph plots the case where the core metal temperature is 230° C. and a broken line plots the case where the core metal temperature is 265° C.

It can be seen from FIG. 8 that the higher the initial core metal temperature, the harder the surface temperature of the fixing roller 21 drops. Accordingly, it can be seen that a stand-by time until when the surface temperature of the fixing roller 21 drops by Δ40° C. is 120 sec and that the stand-by time can be shortened to a half as compared to 240 sec of the conventional example.

[Flow of Operations in Temperature Adjustment Up Mode from Thin Sheet to Thick Sheet]

In succession, the actual operation flow will be explained by using the flowchart in FIG. 6 and by exemplifying a consolidated job in which the job is switched from 100 thin sheets having 70 g/m$^2$ of basis weight to the 100 thick sheets having 300 g/m$^2$ of basis weight.

The operation of Steps 101 and 102 is assumed to be the same with the case of the temperature adjustment Down mode described above. In Step S103, the control portion 29 judges whether the temperature adjustment Down mode or the temperature adjustment Up mode should be carried out on the fixing temperature adjustment temperature of the preceding job. Here, because the temperature of the thick sheet in the succeeding job is 170° C. with respect to the temperature of the thin sheet in the preceding job of 130° C., the control portion 29 judges that the temperature adjustment Up mode should be carried out. Accordingly, on and after Step S112, the control portion 29 separates the external heating belt 23 from the fixing roller 21 and stops the operation of the cooling fan 38 when the preceding job is finished in the fourth mode. Then, the control portion 29 executes the succeeding job when the detected temperature of the fixing temperature detecting thermistors 28*a* and 28*b* reaches the target temperature of the succeeding job.

That is, in Step S112, the control portion 29 judges whether or not a remaining number of sheets to be printed N1 of the preceding job is N1≤20. Here, because the number of remaining sheets is 100−50=50 at the point of time when the control portion 29 has accepted the succeeding job on the $50^{-th}$ sheet, the control portion 29 judges that N1>20 sheets. Accordingly, the control portion 29 advances to Step S113 after feeding the $80^{-th}$ thick sheet of the preceding job where N1≤20.

In Step S113, the control portion 29 judges whether or not a number of accumulated fed sheets N2 of the preceding job is N2>20. Here, because the process does not advance to Step S 114 until when the $80^{-th}$ sheet is fed after accepting the succeeding job on the $50^{-th}$ sheet, the control portion 29 judges that N2>20 sheets. Accordingly, the control portion 29 advances the process to Step S114.

In Step S114, the control portion 29 controls the fixing temperature adjustment temperature control portion 27 and the external heating temperature adjustment temperature control portion 35 such that the fixing temperature adjustment temperature (target temperature) rises and the externally heated temperature adjustment temperature is maintained (turned ON). Here, the fixing temperature adjustment temperature is raised from 130° C. to 140° C.

In Step S115, the control portion 29 controls the cooling fan operation control portion 40 such that the cooling fan 38 is turned ON.

In Step S116, the control portion 29 judges whether or not the sheets of the preceding job have been finished to be fed. Here, the control portion 29 judges that the feed of the sheets of the preceding job has been finished in a stage when the 100 sheets have been fed, so that the control portion 29 advances the process to Step S117.

In Step S117, the control portion 29 controls the external heating contact/separation mechanism 39 to separate (detach) the external heating belt 23 from the fixing roller 21.

In Step S118, the control portion 29 controls the cooling fan operation control portion 40 so as to turn OFF the cooling fan 38.

In Step S119, the control portion 29 judges whether or not temperatures of the external heating belt 23 and the fixing roller 21 have reached the preset temperature adjustment temperature (target temperature) of the succeeding job. Here, because the temperature adjustment temperature of the fixing roller of the succeeding job is 130° C. and the temperature adjustment temperature of the external heating belt is 170° C., the control portion 29 advances the process to Step S120 in a stage when the temperature adjustment temperature of the fixing roller reaches 130° C. and the temperature adjustment temperature of the external heating belt reaches 170° C.

In Step S120, the control portion 29 starts to process the 100 thick sheets whose basis weight is 300 g/m$^2$ of the succeeding job.

Figure 9:
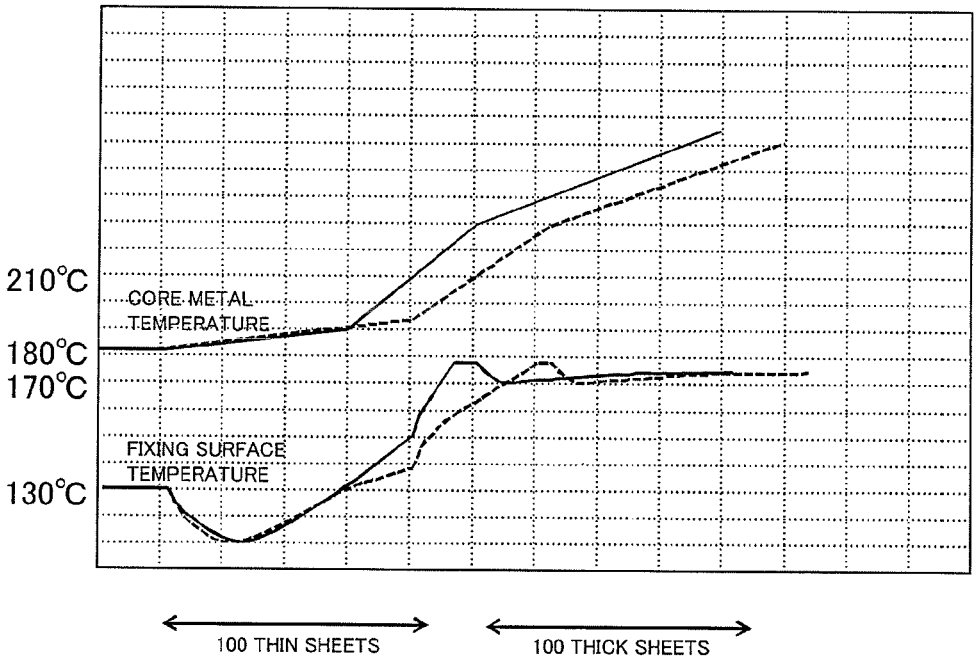
FIG. 9 is a graph showing transitions of temperatures of the surface and the core metal of the fixing roller in an operation flow during a temperature adjustment Up mode of the first embodiment.

FIG. 9 is a graph showing transitions of the temperatures of the surface of the fixing roller 21 and of the core metal of the fixing roller 21 in the operation flow during the temperature adjustment Up mode described above. Solid lines in the graph indicate the transitions of the temperatures when the job of switching from the 100 thin sheets of A4 size having 70 g/m$^2$ of basis weight to the 100 thick sheets of A4 size having 300 g/m$^2$ of basis weight was carried out from the stand-by state. Broken lines indicate transitions of temperatures in a conventional case where the switching job is carried out without employing the present invention.

It can be seen from FIG. 9 that the temperature of the core metal 24*a* of the fixing roller 21 maintains a constant temperature adjustment in a state in which the fixing temperature adjustment temperature (target temperature) is turned ON at 130° C. while feeding the sheets. However, it can be seen that in a case where the present embodiment is employed, the temperature gradually increases when the fixing temperature adjustment temperature (target temperature) is turned ON and the cooling fan 38 is turned ON at the $80^{-th}$ sheet. According to the temperature adjustment Up mode of the present embodiment, the core metal temperature at a point of time when the preceding job (thin sheet job) is finished is 210° C. and is high by 20° C. as compared to 190° C. of the conventional example.

Figure 10:
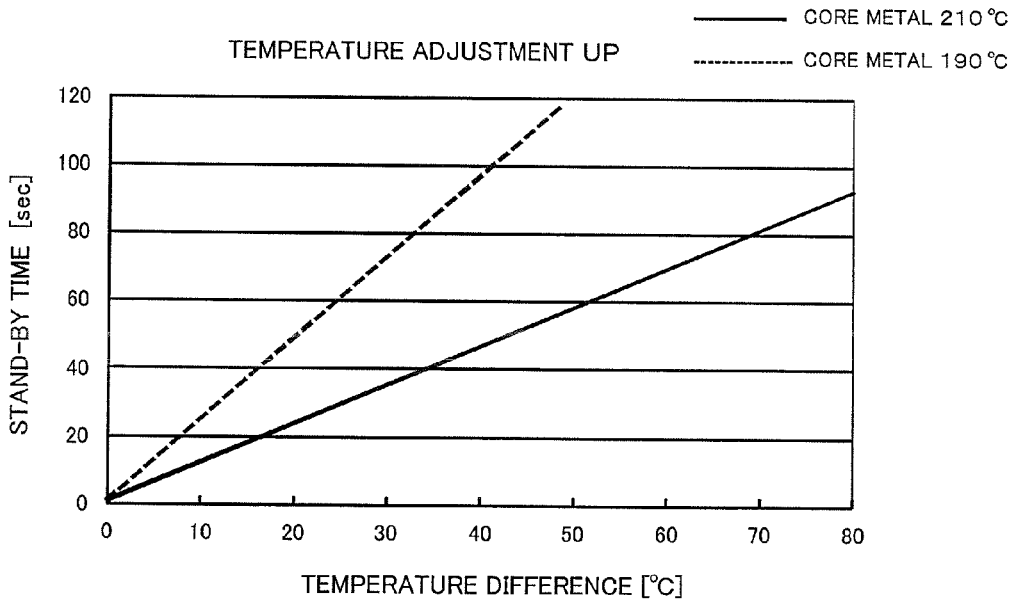
FIG. 10 is a graph indicating a time required to lower a temperature difference Δ in the first embodiment.

FIG. 10 is a graph indicating a time required to lower a temperature difference Δ. A solid line in the graph plots the case where the core metal temperature is 210° C. and a broken line plots the case where the core metal temperature is 190° C.

It can be seen from FIG. 10 that the higher the initial core metal temperature, the easier the surface temperature of the fixing roller 21 increases. Accordingly, a stand-by time until when the surface temperature of the fixing roller 21 rises by Δ30° C. is 50 sec and that the stand-by time can be shortened to a half as compared to 100 sec of the conventional example.

As described above, it is possible to shorten the stand-by time for switching the media by adequately controlling the temperature adjustment temperature (target temperature) of the fixing roller 21, the temperature adjustment temperature of the external heating belt 23, and the operation of the cooling fan 38 in the temperature adjustment mode during the media consolidated job. This makes it possible to improve productivity of the image forming apparatus 1. Thus, the present embodiment makes it possible to shorten the stand-by time for switching the media and to improve the productivity in the media consolidated job in which the different types of media are mixed.

Second Embodiment

Figure 11:
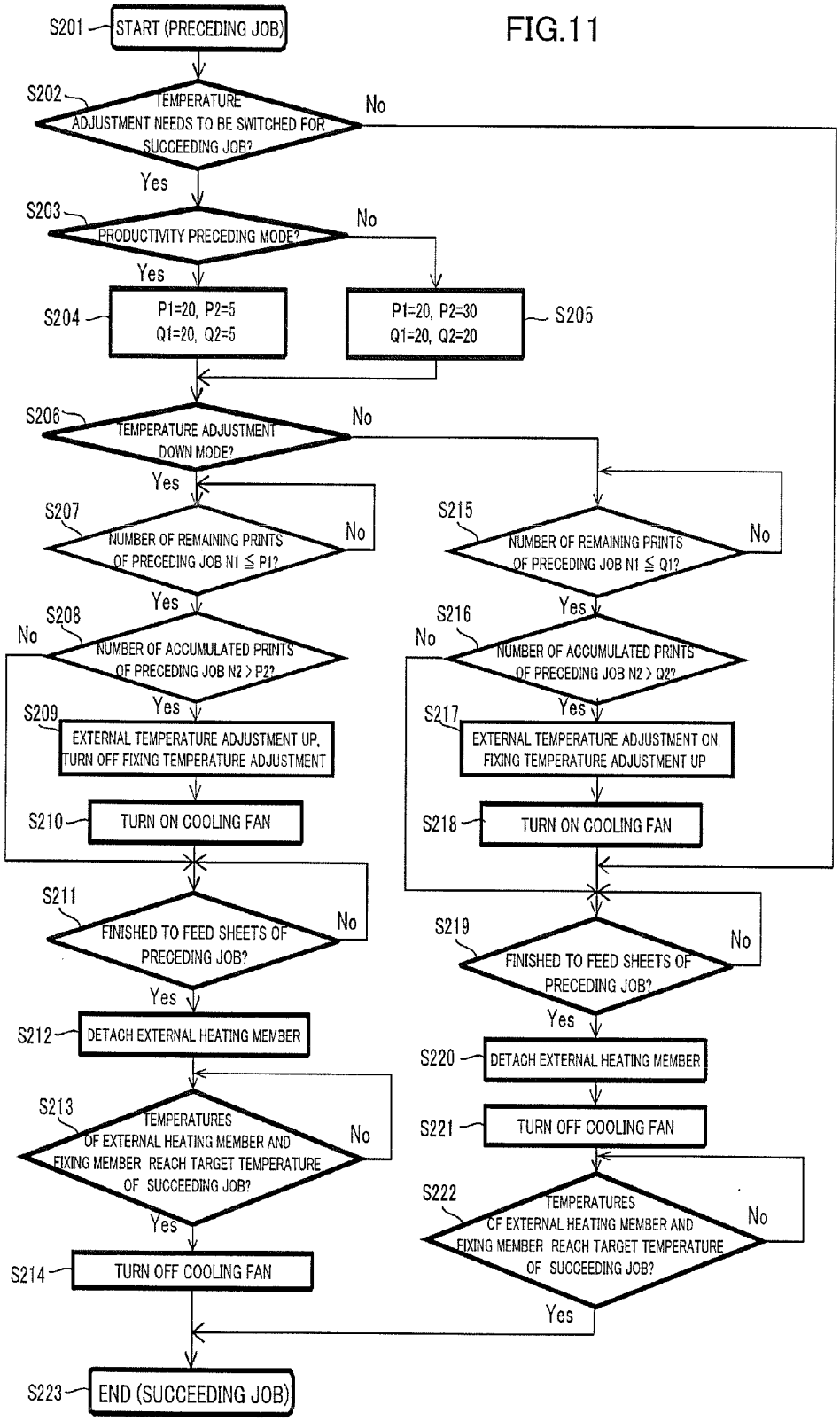
FIG. 11 is a flowchart showing operations in a second embodiment.

Next, a second embodiment of the present invention will be described with reference to FIG. 11. Because the configuration of the image forming apparatus 1 of the present embodiment is the same with the configuration of the image forming apparatus 1 described in the first embodiment, the configuration of the image forming apparatus 1 will be omitted here, and the description will be made by making reference to FIGS. 1 through 5 used in the first embodiment.

In the present embodiment, the control portion 29 judges whether or not a number recording media in the preceding job is a predetermined number or more or less than the predetermined number, and when the number is the predetermined number or more, the control portion 29 executes the second mode after processing a first number of sheets after executing the first mode in the preceding job. Then, when the number of sheets is less than the predetermined number, the control portion 29 executes the second mode after processing a second number of sheets which is less than the first number of sheets. A relationship between the first and second modes is the same also in the relationship between the third and fourth modes and may be applied also in the first embodiment described above.

That is, the abovementioned control is not carried out and the consolidated job control in processing the thick sheet and consolidated job control in processing the thin sheet are not executed when a number of print sheets of the preceding job N=20 or less, e.g., 10 sheets, in the first embodiment. However, there may be a case when a drop of image quality is not problematic depending on image data, surface natures of media, and an operating environment of a printer. There may be also a case where it is desirable to shorten a stand-by time even if the image quality drops more or less.

Accordingly, a threshold value of a number of accumulated print sheets of the preceding job for judging whether or not the consolidated job control in processing the thick sheet is carried out will be set to be Pin the second embodiment. Then, in a case where a threshold value for judging whether or not the consolidated job control in processing the thin sheet is carried out is set to be Q, a productivity preceding mode that lowers these P and Q values are provided to be able to select either one.

While the present embodiment will be described, the configurations and operations of the image forming apparatus 1 and the fixing apparatus 20 correspond to those of the first embodiment unless particularly specified and an overlapped explanation thereof will be omitted here.

An actual operation flow will be explained by using a flowchart in FIG. 11 and by exemplifying a case of a consolidated job in which the job is switched from 10 thick sheet having 300 g/m$^2$ of basis weight to 10 thin sheets having 70 g/m$^2$ of basis weight.

At first, the control portion 29 accepts switching of the recording media while executing the preceding job in Step S201. The control portion 29 judges switching of the recording media based on the recording medium information, image information and job information stored in the job information holding portion 141. Here, it is supposed that the control portion 29 accepts the printing job of 10 thick sheets having 300 g/m$^2$ of basis weight as a preceding job plus printing job of 10 sheets having 70 g/m$^2$ of basis weight as a succeeding job.

The job information holding portion 141 of the present embodiment also has sheet feeding mode information notifying whether or not the productivity preceding mode. This sheet feeding mode information is inputted by the user from the manipulation portion 142.

In Step S202, the control portion 29 judges whether or not it is necessary to switch the temperature adjustment based on fixing temperature adjustment temperatures (target temperature) of the preceding job and the succeeding job calculated from the recording medium information on basis weights and surface natures.

In Step S203, the control portion 29 judges whether or not a mode is the productivity preceding mode of preceding productivity even if the image quality is low from the sheet feeding mode information. Here, the mode is judged to be the productivity preceding mode. Accordingly, the control portion 29 advances the process to Step S204. Meanwhile, if the control portion 29 judges that the mode is not the productivity preceding mode in Step S203, the control portion 29 advances the process to Step S205. In Step S205, a threshold value of a number of accumulated print sheets of the preceding job for judging whether the consolidated job control in processing the thick sheet is carried out is set to be P1=20 sheets or P2=30 sheets. A threshold value of judging whether or not the consolidated job control in processing the thin sheet is carried out is set as Q1=20 sheets or Q2=20 sheets.

In Step S204, the control portion 29 sets the threshold value of a number of accumulated print sheets of the preceding job for judging whether or not the consolidated job control in processing the thick sheet is carried out as P2=5 sheets and the threshold value of judging whether or not the consolidated job control in processing the thin sheet is carried out as Q2=5 sheets.

In Step S206, the control portion 29 judges whether the temperature adjustment Down mode or the temperature adjustment Up mode should be carried out on the fixing temperature adjustment temperature of the preceding job. In a case where the temperature of the thin sheet in the succeeding job is 130° C. with respect to the temperature of the thick sheet in the preceding job of 170° C., the control portion 29 judges that the temperature adjustment Down mode should be carried out and advances to Step S207. Meanwhile, when the control portion 29 judges that the temperature adjustment Up mode should be carried out, the control portion 29 advances the process to Step S214.

In Step S207, the control portion 29 judges whether or not a remaining number of sheets to be printed N1 of the preceding job is N1≤P1 (20 sheets). Here, because a number of the thick sheets of the preceding job is 10 and a number of the thin sheets of the succeeding job is 10, the number of remaining print sheets N1≤P1 (20 sheets), so that the control portion 29 advances the process to Step S208 after performing the sheet feeding process of the preceding job.

In Step S208, the control portion 29 judges whether or not a number of accumulated fed sheets N2 of the preceding job is N2>P2 (5 sheets). When the control portion 29 judges that N2>P2 (5 sheets) as a result, the control portion 29 advances the process to Step S209.

In Step S209, the control portion 29 controls the fixing temperature adjustment temperature control portion 27 and the external heating temperature adjustment temperature control portion 35 (see FIG. 5) such that the external heating temperature adjustment by the external heating belt 23 is raised and the fixing temperature adjustment by the fixing roller 21 is turned OFF.

In succession, the control portion 29 controls the cooling fan operation control portion 40 (see FIG. 5) such that the cooling fan 38 is turned ON in Step S210.

In Step S211, the control portion 29 judges whether or not the sheets of the preceding job have been finished to be fed, and when the control portion 29 judges that the feed of the preceding job has been finished, the control portion 29 advances the process to Step S212.

In Step S212, the control portion 29 controls the external heating contact/separation mechanism 39 to separate (detach) the external heating belt 23 from the fixing roller 21.

In Step S213, the control portion 29 judges whether or not temperatures of the external heating belt 23 and the fixing roller 21 have reached the temperature adjustment temperature (target temperature) of the succeeding job, and advances the process to Step S214 at a point of time when they have reached the temperature adjustment temperature.

In Step S214, the control portion 29 controls the cooling fan operation control portion 40 so as to turn OFF the cooling fan 38.

In Step S222, the control portion 29 starts to process the 10 thin sheets whose basis weight is 70 g/m$^2$ of the succeeding job.

Meanwhile, in Step S215 to which the process has advanced by judging that the temperature adjustment Up mode should be carried out in Step S206, the control portion 29 judges whether or not a number of remaining print sheets of the preceding job is N1≤Q1 (20 sheets). If N1≤Q1 (20 sheets) as a result, the control portion 29 advances the process to Step S216 after performing the sheet feeding process of the preceding job.

In Step S216, the control portion 29 judges whether or not a number of accumulated sheets of the preceding job is N2>Q2 (5 sheets), and when the control portion 29 judges as N2>Q2, the control portion 29 advances the process to Step S217.

In Step S217, the control portion 29 controls the fixing temperature adjustment temperature control portion 27 and the external heating temperature adjustment temperature control portion 35 so as to raise the fixing temperature adjustment temperature (target temperature) and to turn On the external heating temperature adjustment temperature.

In succession, in Step S218, the control portion 29 controls the cooling fan operation control portion 40 so as to turn ON the cooling fan 38.

In Step S219, the control portion 29 judges whether or not the feed of the sheets of the preceding job has been finished, and judges that the feed of the preceding job has been finished, the control portion 29 advances the process to Step S220.

In Step S220, the control portion 29 controls the external heating contact/separation mechanism 39 to separate (detach) the external heating belt 23 from the fixing roller 21.

in Step S221, the control portion 29 controls the cooling fan operation control portion 40 so as to turn OFF the cooling fan 38.

In Step S222, the control portion 29 judges whether or not temperatures of the external heating belt 23 and the fixing roller 21 have reached the preset temperature adjustment temperature (target temperature) of the succeeding job. In a case where the control portion 29 judges that the they have reach the preset temperature adjustment temperature of the succeeding job, the control portion 29 advances the process to Step S223 to start to process the 10 thick sheet having 300 g/m$^2$ of basis weight of the succeeding job.

According to the present embodiment described above, it is possible to shorten the stand-by time even when the number of print sheets of the preceding job is less than N=20. The present embodiment as described above also makes it possible to shorten the stand-by time in switching the media and to improve the productivity in the media consolidated job in which the different types of media are mixed. It is noted that the configuration described above is also applicable in the first embodiment described above.

The following control is also possible. That is, the control portion 29 judges whether a number of recording media in the preceding job is a predetermined number or more or less than the predetermined number, and when the number is the predetermined number or more, the control portion 29 executes the second mode (fourth mode) after processing a first number of sheets after executing the first mode (third mode) in the preceding job. Then, when the number is less than the predetermined number, the control portion 29 executes only the first mode (third mode). Thus, it is possible to configure such that the second mode (fourth mode) is not executed when the number is less than the predetermined number. This configuration is also applicable in the first embodiment described above.

Or, it is also possible to control as follows. That is, the control portion 29 judges whether a number of recording media in the preceding job is a predetermined number or more or less than the predetermined number, and when the number is the predetermined number or more, the control portion 29 executes the second mode (fourth mode) after processing a first number of sheets after executing the first mode (third mode) in the preceding job. Then, when the number is less than the predetermined number, the control portion 29 is made selectable to execute the second mode (fourth mode) after processing the second number of sheets which is less than the first number of sheets or to execute only the first mode (third mode). Thus, it is possible to select whether or not the second mode (fourth mode) is executed when the number is less than the predetermined number. This configuration is also applicable in the first embodiment described above.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment (s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-081873, filed Apr. 10, 2013 which is hereby incorporated by reference herein in its entirety.

What is claimed is:

1. An image heating apparatus comprising:

an image heating member configured to heat an image on a recording medium;

an image heating temperature detecting member detecting a surface temperature of the image heating member in contact with the image to be heated;

a first temperature adjustment portion adjusting the surface temperature of the image heating member from inside of the image heating member;

a second temperature adjustment portion adjusting the surface temperature of the image heating member from outside of the image heating member; and a control portion controlling the first and second temperature adjustment portions and configured to execute a temperature adjustment Down preliminary control operation in the middle of heating of a plurality of first recording media in a case of heating a second recording medium whose basis weight is smaller than that of a first recording medium of the plurality of the first recording media in succession after heating the plurality of first recording media, the control portion executing the temperature adjustment Down preliminary control operation, while maintaining a setting of a target temperature of the surface temperature detected by the image heating temperature detecting member at a target temperature corresponding to the first recording medium, by reducing the quantity of heat supplied from the first temperature adjustment portion to the image heating member and by controlling the second temperature adjustment portion such that the surface temperature detected by the image heating temperature detecting member is adjusted to the target temperature corresponding to the first recording medium.

2. The image heating apparatus according to claim 1, wherein the control portion is configured to execute a temperature adjustment Up preliminary control operation in the middle of heating of the plurality of second recording media in a case of heating the first recording medium in succession after heating the plurality of second recording media, the control portion executing the temperature adjustment Up preliminary control operation, while maintaining the setting of the target temperature of the surface temperature detected by the image heating temperature detecting member at a target temperature corresponding to the second recording mediums by increasing the quantity of heat supplied from the first temperature adjustment portion to the image heating member and by controlling the second temperature adjustment portion such that the surface a temperature detected by the image heating temperature detecting member is adjusted to the target temperature corresponding to the second recording medium.

3. The image heating apparatus according to claim 2, wherein the first temperature adjustment portion includes a heat source heating the image heating member from the inside of the image heating member, and wherein the second temperature adjustment portion includes an external heating member heating the image heating member from the outside of the image heating member in a state in contact with the image heating member and a cooling fan cooling a surface of the image heating member, the control portion reducing the quantity of heat supplied from the heat source to the image heating member, increasing the quantity of heat supplied from the external heating member to the image heating member, and starting to operate the cooling fan in the middle of heating of the plurality of first recording media in executing the temperature adjustment Down preliminary control operation, and the control portion increasing the quantity of heat supplied from the heat source to the image heating member, reducing the quantity of heat supplied from the external heating member to the image heating member, and starting to operate the cooling fan while heating the plurality of second recording media in executing the temperature adjustment Up preliminary control operation.

4. An image forming apparatus comprising:

an image forming portion forming a toner image on a recording medium; and an image heating apparatus as set forth in claim 1 configured to fix the toner image formed on the recording medium by the image forming portion to the recording medium.

5. An image forming apparatus comprising;

an image forming portion configured to form an image on a sheet having a second basis weight which is smaller than a first basis weight in succession after forming images on a plurality of sheets each having the first basis weight;

a heating roller heating the sheet conveyed from the image forming portion at a nip portion;

a nip forming member forming the nip portion with the heating roller;

a heater provided within the heating roller and heating the heating roller from inside of the heating roller;

an external heating unit heating the heating roller from outside of the heating roller by being in contact with an outer surface of the heating roller;

a first detecting portion detecting the temperature of the outer surface of the heating roller downstream of the external heating unit and upstream of the nip portion in a rotation direction of the heating roller;

a second detecting portion detecting the temperature of the external heating unit; and a control portion controlling the heater and the external heating unit such that the temperature of the outer surface of the heating roller is controlled at a predetermined temperature in heating the sheet having the first basis weight, and is controlled at a lower temperature than the predetermined temperature in heating the sheet having the second basis weight, wherein the control portion controls the heater based on a detection of the first detecting portion such that the temperature of the outer surface becomes the predetermined temperature, and controls the external heating unit based on a detection of the second detecting portion such that the temperature of the external heating unit becomes a first temperature until the number of remaining sheets to be heated among the plurality of sheets each having the first basis weight reaches a predetermined number, and wherein the control portion stops a heating operation of the heater and controls the external heating unit based on the detection of the second detecting portion such that the temperature of the external heating unit becomes a second temperature which is higher than the first temperature after the number of remaining sheets reaches the predetermined number.

6. The image forming apparatus according to claim 5, wherein the external heating unit includes an endless belt in contact with the heating roller, first and second supporting rollers rotatably supporting the endless belt by being in contact with an inner surface of the endless belt, and a belt heater heating the endless belt, wherein the second detecting portion detects the temperature of an outer surface of the endless belt.

7. The image forming apparatus according to claim 6, wherein the belt heater is provided within the first supporting roller and the thickness in a radial direction of the heating roller is thicker than the thickness in the radial direction of the first supporting roller.

8. The image forming apparatus according to claim 7, wherein the diameter of the heating roller is larger than the diameter of the first supporting roller.

9. The image forming apparatus according to claim 5, further comprising a cooling fan cooling the heating roller, wherein the control portion controls the cooling fan to start blowing toward the heating roller after the number of remaining sheets reaches the predetermined number.

10. The image forming apparatus according to claim 5, further comprising a separation portion configured to separate the external heating unit from the heating roller for a period after finishing the operation of heating the plurality of sheets each having the first basis weight and before starting the heating operation of heating the sheet having the second basis weight.

* * * * *